US008742999B2

(12) United States Patent
Amari et al.

(10) Patent No.: US 8,742,999 B2
(45) Date of Patent: Jun. 3, 2014

(54) ANTENNA APPARATUS FOR SIMULTANEOUSLY TRANSMITTING MULTIPLE RADIO SIGNALS WITH DIFFERENT RADIATION CHARACTERISTICS

(75) Inventors: Satoru Amari, Osaka (JP); Atsushi Yamamoto, Kyoto (JP); Tsutomu Sakata, Osaka (JP)

(73) Assignee: Panasonic Corporation, Osaka (JP)

( * ) Notice: Subject to any disclaimer, the term of this patent is extended or adjusted under 35 U.S.C. 154(b) by 216 days.

(21) Appl. No.: 13/257,108

(22) PCT Filed: Dec. 20, 2010

(86) PCT No.: PCT/JP2010/007373

§ 371 (c)(1),
(2), (4) Date: Sep. 16, 2011

(87) PCT Pub. No.: WO2011/089676

PCT Pub. Date: Jul. 28, 2011

(65) Prior Publication Data

US 2012/0007785 A1 Jan. 12, 2012

(30) Foreign Application Priority Data

Jan. 19, 2010 (JP) ..... 2010-008654

(51) Int. Cl.
*H01Q 9/04* (2006.01)

(52) U.S. Cl.
CPC ..... *H01Q 9/0407* (2013.01); *H01Q 9/0435* (2013.01)
USPC ..... 343/722; 343/700 MS

(58) Field of Classification Search
CPC ..... H01Q 9/0407; H01Q 9/0435
USPC ..... 343/722, 700 MS, 702, 850, 852
See application file for complete search history.

(56) References Cited

U.S. PATENT DOCUMENTS 7,589,687 B2 9/2009 Iwai et al.
7,889,143 B2 2/2011 Milosavljevic et al.

(Continued)

FOREIGN PATENT DOCUMENTS

CN 101197464 6/2008
CN 101278440 10/2008

(Continued)

OTHER PUBLICATIONS

International Search Report issued Mar. 29, 2011 in International (PCT) Application No. PCT/JP2010/007373.

(Continued)

*Primary Examiner* — Hoanganh Le
(74) *Attorney, Agent, or Firm* — Wenderoth, Lind & Ponack, L.L.P.

(57) ABSTRACT

An antenna element has a slit including a first portion and a second portion, the first portion extending in a first direction so as to separate first and second feed points from each other, and the second portion extending in a second direction different from the first direction. The slit is configured to resonate at an isolation frequency to produce isolation between the first and second feed points, and configured to form a current path around the slit. A current distribution along the current path generated by exciting through the first feed point is different from a current distribution along the current path generated by exciting through the second feed point, thus providing different radiation characteristics by the different current distributions.

7 Claims, 21 Drawing Sheets

(56) References Cited

U.S. PATENT DOCUMENTS

| | | | | |
|---|---|---|---|---|
| 8,264,414 | B2 * | 9/2012 | Sakata et al. | 343/702 |
| 2003/0160728 | A1 | 8/2003 | Fukushima et al. | |
| 2005/0253757 | A1 * | 11/2005 | Liu et al. | 343/700 MS |
| 2007/0080872 | A1 | 4/2007 | Nishikido et al. | |
| 2008/0143612 | A1 | 6/2008 | Iwai et al. | |
| 2008/0143613 | A1 | 6/2008 | Iwai et al. | |
| 2009/0040109 | A1 * | 2/2009 | Iguchi et al. | 343/700 MS |
| 2009/0195469 | A1 | 8/2009 | Lim et al. | |
| 2009/0295643 | A1 * | 12/2009 | Angell et al. | 343/700 MS |
| 2010/0149057 | A9 | 6/2010 | Milosavljevic et al. | |
| 2010/0207823 | A1 | 8/2010 | Sakata et al. | |

FOREIGN PATENT DOCUMENTS

| | | |
|---|---|---|
| EP | 1 296 407 | 3/2003 |
| EP | 1 335 449 | 8/2003 |
| JP | 2005-130216 | 5/2005 |
| JP | 2008-167421 | 7/2008 |
| WO | 01/97325 | 12/2001 |
| WO | 02/39544 | 5/2002 |
| WO | 02/075853 | 9/2002 |
| WO | 2009/130887 | 10/2009 |

OTHER PUBLICATIONS

International Preliminary Report on Patentability issued Aug. 16, 2012 in International (PCT) Application No. PCT/JP2010/007373.

Chinese Office Action issued Dec. 23, 2013 in corresponding Chinese Patent Application No. 201080012046.5.

* cited by examiner

ANTENNA APPARATUS FOR SIMULTANEOUSLY TRANSMITTING MULTIPLE RADIO SIGNALS WITH DIFFERENT RADIATION CHARACTERISTICS

TECHNICAL FIELD

The present invention mainly relates to an antenna apparatus for mobile wireless communication apparatuses such as mobile phones, and relates to a wireless communication apparatus provided with the antenna apparatus.

BACKGROUND ART

The size and thickness of portable wireless communication apparatuses, such as mobile phones, have been rapidly reduced. In addition, the portable wireless communication apparatuses have been transformed from apparatuses to be used only as conventional telephones, to data terminals for transmitting and receiving electronic mails and for browsing web pages of WWW (World Wide Web), etc. Further, since the amount of information to be handled has increased from that of conventional audio and text information to that of pictures and videos, a further improvement in communication quality is required. In such circumstances, some steerable antenna apparatuses have been proposed.

Patent Literature 1 discloses an antenna device including a rectangular conductive substrate, and a planar antenna over a dielectric on the substrate. The antenna device is characterized in that a current flows in one diagonal direction on the substrate by exciting the antenna in a direction, and another current flows in the other diagonal direction on the substrate by exciting the antenna in a different direction. Thus, the antenna device of Patent Literature 1 can change its directional pattern and direction of polarization by changing the direction of a current flowing on the substrate.

Patent Literature 2 discloses a flip-type portable wireless apparatus with a open/close mechanism in which first and second housings are connected via a hinge, the portable wireless apparatus includes: a first planar conductor disposed on a first surface of the first housing along a longitudinal direction of the first housing; second and third planar conductors disposed on a second surface of the first housing opposing to the first surface, along the longitudinal direction of the first housing; and feeding means for feeding the first planar conductor and for selectively feeding the second or third planar conductor with a different phase than that used to feed the first planar conductor. The portable wireless apparatus of Patent Literature 2 can switch between the second and third planar conductors in response to a reduction in reception level, thus improving communication performance.

Patent Literature 3 discloses a portable radio unit including a dipole antenna; and two feeder means each connected to one of two antenna elements composing the dipole antenna.

Patent Literatures 4 and 5 disclose antenna apparatuses including first and second feed points respectively provided at positions on an antenna element, the antenna element being simultaneously excited through the first and second feed points so as to simultaneously operate as first and second antenna portions respectively associated with the first and second feed points, the antenna element further including electromagnetic coupling adjustment means provided between the first and second feed points for producing isolation between the first and second feed points. The antenna apparatuses of Patent Literatures 4 and 5 can simultaneously transmit and/or receive a plurality of radio signals with low correlation to each other, while having a simple configuration.

CITATION LIST

Patent Literature

PATENT LITERATURE 1: PCT International Publication No. WO02/39544

PATENT LITERATURE 2: Japanese Patent Laid-open Publication No. WO01/97325

PATENT LITERATURE 4: PCT International Publication No. WO2009/130887

PATENT LITERATURE 5: Japanese Patent Laid-open Publication No. 2008-167421

SUMMARY OF INVENTION

Technical Problem

In recent years, there has been an increasing need to increase the data transmission rate on mobile phones, and thus, a next generation mobile phone standard, 3G-LTE (3rd Generation Partnership Project Long Term Evolution) has been studied. According to 3G-LTE, it has been determined to adopt the MIMO (Multiple Input Multiple Output) technique for simultaneously transmitting and/or receiving radio signals of a plurality of channels through a plurality of antennas using the spatial division multiplexing, as a new technique for increasing the wireless transmission rate.

According to MIMO communication, the transmission rate can be increased by providing each of the transmitter and receiver with a plurality of antennas, and spatially multiplexing data streams. According to MIMO communication, a plurality of antennas simultaneously operate at the same frequency. Therefore, under circumstances where a plurality of antennas are disposed close to each other within a small mobile phone, the electromagnetic coupling among the antennas becomes very strong. When the electromagnetic coupling among the antennas becomes strong, the radiation efficiency of the antennas degrades, and accordingly, received radio waves are weakened, thus reducing the transmission rate. Therefore, there is a need for an array antenna that has low coupling even if a plurality of antennas are disposed close to each other. In addition, according to MIMO communication, it is necessary to transmit and/or receive a plurality of radio signals with low correlation to each other by using different directional patterns, polarization characteristics, etc. per antenna, thus achieving the spatial division multiplexing.

Although the antenna device of Patent Literature 1 can change its directional pattern to a different one, it cannot achieve a plurality of different directional patterns simultaneously. The portable wireless apparatus of Patent Literature 2 requires a plurality of antenna elements (planar conductors), and thus, results in a complicated structure. Further, like the antenna device of Patent Literature 1, although the portable wireless apparatus of Patent Literature 2 can change its directional pattern to a different one, it cannot achieve a plurality of different directional patterns simultaneously. The portable radio unit of Patent Literature 3 cannot change its directional pattern, and cannot achieve a plurality of different directional patterns simultaneously. Although the antenna apparatuses of Patent Literatures 4 and 5 simultaneously transmit and/or receive a plurality of radio signals with low correlation to each other, it cannot achieve a plurality of different directional patterns simultaneously.

An object of the present invention is to solve the above-described problems, and provide an antenna apparatus capable of simultaneously transmitting and/or receiving a plurality of radio signals with low correlation to each other, with different radiation characteristics, while having a simple configuration, and provide a wireless communication apparatus provided with such an antenna apparatus.

Solution to Problem

According to an antenna apparatus of an aspect of the present invention, the antenna apparatus includes first and second feed points provided at respective predetermined positions on an antenna element, the antenna element is simultaneously excited through the first and second feed points so as to simultaneously operate as first and second antenna portions, the first and second antenna portions being associated with the first and second feed points, respectively, and the antenna element has a slit including a first portion and a second portion, the first portion extending in a first direction so as to separate the first and second feed points from each other, and the second portion extending in a second direction different from the first direction. The slit is configured to resonate at an isolation frequency to produce isolation between the first and second feed points, and configured to form a current path around the slit. A current distribution along the current path generated by exciting the antenna element through the first feed point is different from a current distribution along the current path generated by exciting the antenna element through the second feed point, thus providing different radiation characteristics by the different current distributions.

In the antenna apparatus, one end of the first portion of the slit is an opening, and the other end of the first portion of the slit is connected to the second portion of the slit, and the second portion of the slit has at least two closed ends. For an operating wavelength 2 of the antenna apparatus and integers n1 and n2, the current path around the slit is formed such that: an electrical length of a portion of the current path from the opening of the slit on a side of the first feed point to a first closed end of the at least two closed ends is $(1/4+(n1)/2)\lambda$, and the current distribution along the current path generated by exciting the antenna element through the first feed point has a current antinode at the first closed end; and an electrical length of a portion of the current path from the opening of the slit on a side of the second feed point to a second closed end of the at least two closed ends is $(1/4+(n2)/2)\lambda$, and the current distribution along the current path generated by exciting the antenna element through the second feed point has a current antinode at the second closed end.

In the antenna apparatus, the current distribution along the current path generated by exciting the antenna element through the first feed point has a current distribution substantially reversed from the current distribution along the current path generated by exciting the antenna element through the second feed point.

In the antenna apparatus, the slit is symmetric with respect to an axis passing through the first portion of the slit.

In the antenna apparatus, the slit has a T-shape.

In the antenna apparatus, the slit has a Y-shape.

In the antenna apparatus, the slit is asymmetric with respect to an axis passing through the first portion of the slit.

In the antenna apparatus, the slit has an L-shape.

In the antenna apparatus, the slit is provided with means for adjusting the isolation frequency.

In the antenna apparatus, the means for adjusting the isolation frequency is a reactance element.

In the antenna apparatus, the means for adjusting the isolation frequency is a variable capacitance element.

In the antenna apparatus, the means for adjusting the isolation frequency includes a plurality of reactance elements with different reactance values, and a switch for selectively connecting any of the plurality of reactance elements.

In the antenna apparatus, the slit is provided with filter means at a position along the slit with a distance from the opening of the slit, the filter means being opened at a first frequency and being short-circuited at a second frequency different from the first frequency. The filter means is configured to: at the first frequency, allow the entire slit to resonate to produce isolation between the first and second feed points, and form a current path around the slit without short-circuiting through the filter means; and at the second frequency, allow only a portion from the opening of the slit to the filter means to resonate to produce isolation between the first and second feed points, and form a current path around the slit with short-circuiting through the filter means.

In the antenna apparatus, the filter means is configured such that a series resonant circuit including a first inductor and a first capacitor is connected in series with a parallel resonant circuit including a second inductor and a second capacitor.

In the antenna apparatus, the filter means is configured such that a series resonant circuit including an inductor and a first capacitor is connected in parallel with a second capacitor.

In the antenna apparatus, the filter means is a band-pass filter.

In the antenna apparatus, the filter means is a high-pass filter.

In the antenna apparatus, the filter means is a low-pass filter.

In the antenna apparatus, the filter means is a filter formed by a MEMS (Micro Electro Mechanical Systems) fabrication method.

The antenna apparatus includes impedance matching means for shifting a resonance frequency of the antenna element to the isolation frequency.

According to a wireless communication apparatus of an aspect of the present invention, the wireless communication apparatus transmits and/or receives a plurality of radio signals, and includes the antenna apparatus of the aspect of the present invention.

Advantageous Effects of Invention

As described above, according to the antenna apparatus and the wireless communication apparatus of the present invention, it is possible to provide an antenna apparatus and a wireless communication apparatus capable of simultaneously transmitting and/or receiving a plurality of radio signals with low correlation to each other, with different radiation characteristics, while having a simple configuration.

According to the present invention, while reducing the number of antenna elements to one, it is possible for the antenna element to operate as a plurality of antenna portions, and it is also possible to achieve isolation between the plurality of antenna portions. The most significant effect of the present invention is that even if exciting a single antenna element simultaneously through a plurality of feed points to operate as a plurality of antenna portions, isolation between the antenna portions is achieved, thus reducing the correlation between radio signals transmitted and/or received through the respective antenna portions.

According to the present invention, the antenna apparatus is characterized by a slit being provided to achieve isolation between the feed points at a frequency, and further to form a current path around the slit. A current distribution along the current path generated by exciting through one feed point is different from a current distribution along the current path generated by exciting through the other feed point. According to the present invention, it is possible to generate different current distributions for different feed points, thus achieving different radiation characteristics for the different feed points.

According to the present invention, the antenna apparatus provided with a single antenna element is used to transmit and/or receive radio signals of a plurality of channels according to the MIMO communication scheme, to simultaneously perform wireless communications for a plurality of applications, or to simultaneously perform wireless communications in a plurality of frequency bands, etc.

DESCRIPTION OF EMBODIMENTS

Figure 1:
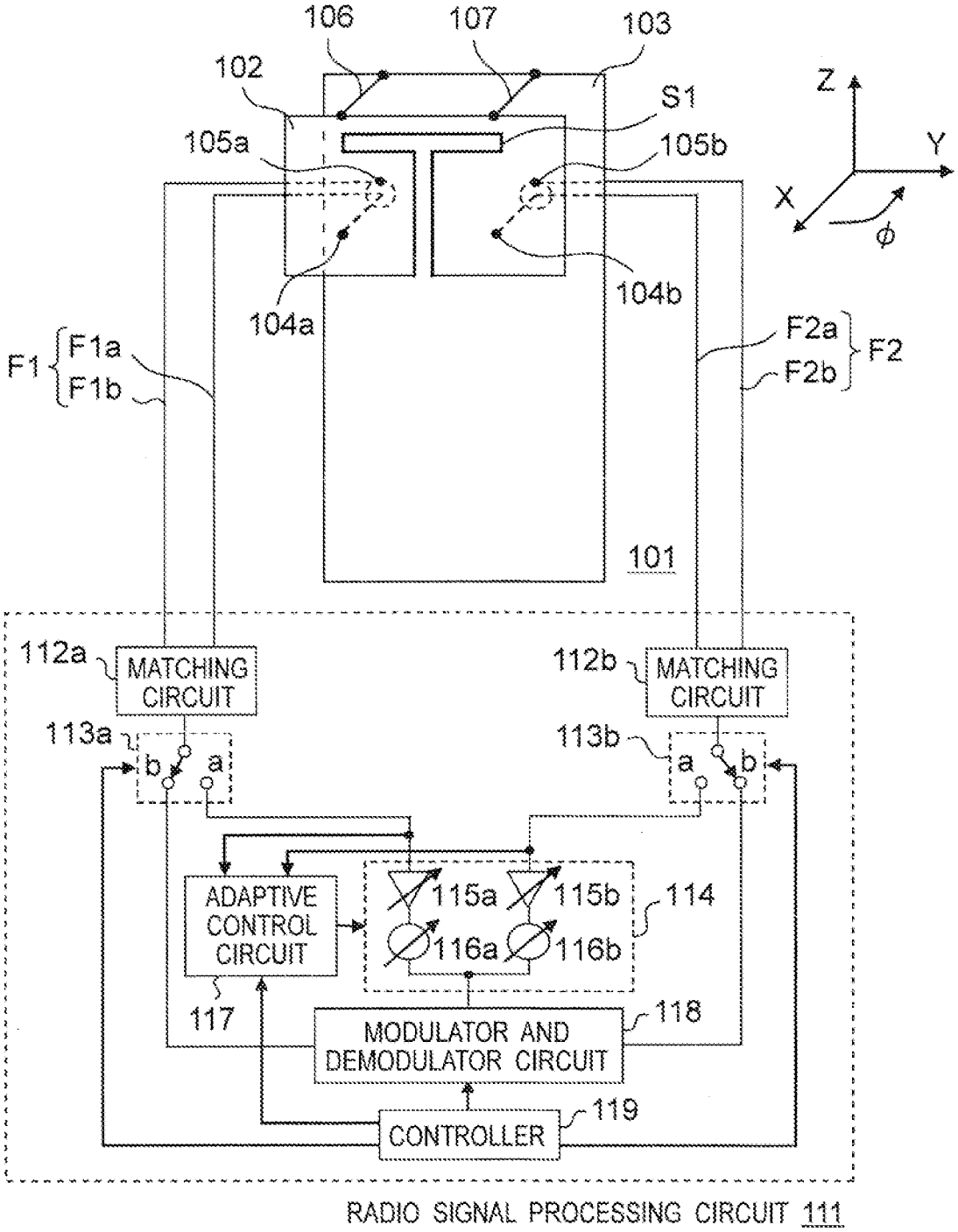
FIG. 1 is a block diagram showing the configurations of an antenna apparatus 101 and a radio signal processing circuit 111 of a wireless communication apparatus according to a first embodiment of the present invention.

Embodiments of the present invention will be described below with reference to the drawings. Note that like components are denoted by the same reference numerals.

First Embodiment

FIG. 1 is a block diagram showing the configurations of an antenna apparatus 101 and a radio signal processing circuit 111 of a wireless communication apparatus according to a first embodiment of the present invention. The antenna apparatus 101 of the present embodiment includes a rectangular antenna element 102 with two different feed points 104*a* and 104*b*, and this single antenna element 102 operates as two antenna portions by exciting the antenna element 102 through the feed point 104*a* as a first antenna portion, and simultaneously, exciting the antenna element 102 through the feed point 104*b* as a second antenna portion.

The antenna apparatus 101 of the present embodiment is further characterized by a slit 51 being provided to achieve isolation between the feed points 104*a* and 104*b* at a frequency, and further to form a current path around the slit 51. The current path includes an extent along a direction (in the case of FIG. 1, portions remote from each other in ±Y directions) so that radiation characteristics in a given plane (in the case of FIG. 1, in an XY plane) change according to a current distribution along the current path. A current distribution along the current path generated by exciting through one feed point 104*a* is different from a current distribution along the current path generated by exciting through the other feed point 104*b*. According to the antenna apparatus 101 of the present embodiment, it is possible to generate different current distributions for different feed points, thus achieving different radiation characteristics for the different feed points.

Referring to FIG. 1, the antenna apparatus 101 includes the antenna element 102 and a ground conductor 103, each made of a rectangular conductive plate. The antenna element 102 and the ground conductor 103 are provided in parallel so as to overlap each other, with a certain distance therebetween. One side of the antenna element 102 and one side of the ground conductor 103 are arranged close to each other, and are mechanically and electrically connected to each other by linear connecting conductors 106 and 107. Further, the feed points 104*a* and 104*b* are provided at predetermined positions on the antenna element 102, and the slit S1 is provided to separate the feed points 104*a* and 104*b* from each other. The slit S1 extends between the side to which the connecting conductors 106 and 107 are connected, and its opposite side. The slit S1 includes a first portion separating the feed points 104*a* and 104*b* from each other (in FIG. 1, a portion extending in a Z-axis direction; in FIG. 2, a portion indicated by reference numeral S1*a*), and a second portion extending in a different direction than that of the first portion (in FIG. 1, a portion extending in a Y-axis direction; in FIG. 2, a portion indicated by reference numeral S1*b*). A bottom end of the first portion of the slit S1 is formed as an open end, with an opening at about the center of the opposite side of the side to which the connecting conductors 106 and 107 are connected, and both ends of the second portion of the slit S1 are formed as closed ends. The feed points 104*a* and 104*b* are respectively connected with feed lines F1 and F2, which penetrate through the ground conductor 103 from its backside. Each of the feed lines F1 and F2 is, for example, a coaxial cable with a characteristic impedance of 50Ω. Signal lines F1*a* and F2*a* as inner conductors of the feed lines F1 and F2 are connected to the feed points 104*a* and 104*b*, respectively, and signal lines F1*b* and F2*b* as outer conductors of the feed lines F1 and F2 are connected to the ground conductor 103 at connecting points 105*a* and 105*b*, respectively. The feed point 104*a* and the connecting point 105*a* act as one feed port of the antenna apparatus 101, and the feed point 104*b* and the connecting point 105*b* act as another feed port of the antenna apparatus 101. As shown in FIG. 1, the antenna apparatus 101 is configured as a planar inverted-F antenna apparatus. As described above, it is possible for the single antenna element 102 to operate as two antenna portions by exciting the antenna element 102 through the feed point 104*a* as the first antenna portion, and simultaneously, exciting the antenna element 102 through the feed point 104*b* as the second antenna portion.

The feed line F1 is connected to a switch 113*a* through an impedance matching circuit (hereinafter, referred to as a "matching circuit") 112*a*, and the feed line F2 is connected to a switch 113*b* through a matching circuit 112*b*. Under the control of a controller 119, the switches 113*a* and 113*b* change between a state in which the antenna element 102 is directly connected to a modulator and demodulator circuit 118, and a state in which the antenna element 102 is connected to the modulator and demodulator circuit 118 through an amplitude and phase control circuit 114. When the antenna element 102 is directly connected to the modulator and demodulator circuit 118, the modulator and demodulator circuit 118 operates as a MIMO modulator and demodulator circuit, and transmits and/or receives radio signals of a plurality of channels according to the MIMO communication scheme (in the present embodiment, two channels) through the antenna apparatus 101. The modulator and demodulator circuit 118 may perform modulation and demodulation of two independent radio signals, instead of MIMO modulation and demodulation. In this case, the wireless communication apparatus of the present embodiment can simultaneously perform wireless communications for a plurality of applications, or simultaneously perform wireless communications in a plurality of frequency bands. On the other hand, when the antenna element 102 is connected to the modulator and demodulator circuit 118 through the amplitude and phase control circuit 114, the amplitude and phase control circuit 114 performs adaptive control of radio signals to be transmitted and/or received, under the control of an adaptive control circuit 117. In this case, the amplitude and phase control circuit 114 includes amplitude adjusters 115*a* and 115*b*, and phase shifters 116*a* and 116*b*. Upon reception, received signals are passed through the switches 113*a* and 113*b*, and then, inputted to the amplitude and phase control circuit 114 and are inputted to the adaptive control circuit 117. The adaptive control circuit 117 preferably performs maximal ratio combining, and accordingly, the adaptive control circuit 117 determines the amounts of amplitude change and phase shift of the received signals based on the inputted received signals, and changes the amplitude and phase of the signal passed through the switch 113*a* by using the amplitude adjuster 115*a* and the phase shifter 116*a*, and changes the amplitude and phase of the signal passed through the switch 113*b* by using the amplitude adjuster 115*b* and the phase shifter 116*b*. The received signals whose amplitudes and phases have been changed are combined together, and the combined signal is inputted to the modulator and demodulator circuit 118. Upon transmission, in order to steer a beam in a desired direction, the adaptive control circuit 117 determines the amounts of amplitude change and phase shift of a transmitting signal under the control of the controller 119, and changes the amplitude and phase of the transmitting signal according to the determination results by using the amplitude and phase control circuit 114. The modulator and demodulator circuit 118 is connected to other circuits external to the radio signal processing circuit 111 (not shown) for further processing signals to be transmitted and/or received. The controller 119 controls the operations of the switches 113*a* and 113*b*, the adaptive control circuit 117, and the modulator and demodulator circuit 118, according to whether to use the MIMO communication scheme or adaptive control.

Figure 2:
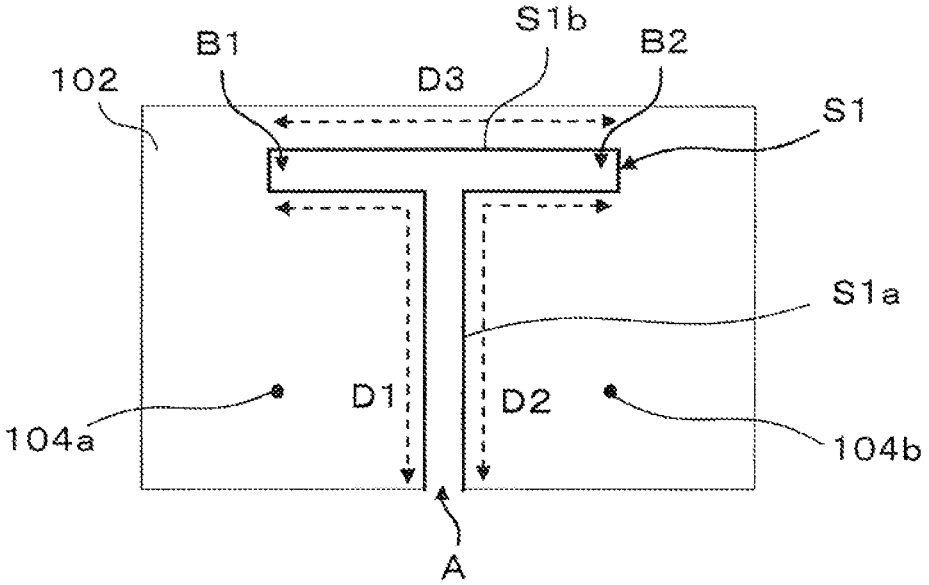
FIG. 2 is a diagram for explaining a slit S1 in an antenna element 102 of FIG. 1.

FIG. 2 is a diagram for explaining the slit S1 in the antenna element 102 of FIG. 1. The electrical lengths D1, D2, and D3 along the current path (i.e., the dimensions of the slit S1) are determined such that a current antinode is formed near one of closed ends B1 and B2 of the slit S1 by exciting through one feed point 104*a*, and a current antinode is formed near the other one of the closed ends B1 and B2 by exciting through the other feed point 104*b*. Specifically, the electrical length D1 is set to $(1/4+(n1)/2)\lambda$, and the electrical length D2 is set to $(1/4+(n2)/2)\lambda$, where λ is the wavelength of radio waves to be transmitted and/or received, and n1 and n2 are integers, respectively. In this case, by exciting through the feed point 104*a*, a current node is formed near an opening A of the slit S1 (on the side of the feed point 104*a*) and a current antinode is formed near the closed end B1; and on the other hand, by exciting through the feed point 104*b*, a current node is formed near the opening A of the slit S1 (on the side of the feed point 104*b*) and a current antinode is formed near the closed end B2. In addition, the electrical length D3 is set to a length of, preferably $\lambda/2$, or its odd multiple. Alternatively, the electrical length D1+D3 may be set to $(1/4+(n1)/2)\lambda$, and the electrical length D2+D3 may be set to $(1/4+(n2)/2)\lambda$. In this case, by exciting through the feed point 104*a* a current node is formed near the opening A of the slit S1 (on the side of the feed point 104*a*) and a current antinode is formed near the closed end B2, and on the other hand, by exciting through the feed point 104*b*, a current node is formed near the opening A of the slit S1 (on the side of the feed point 104*b*) and a current antinode is formed near the closed end B1.

The shape of the slit S1 and the positions of the feed points 104*a* and 104*b* are preferably symmetric with respect to a center line between the feed points 104*a* and 104*b*. In an exemplary implementation shown in FIG. 2, the slit S1 is formed in a T-shape.

Figure 3:
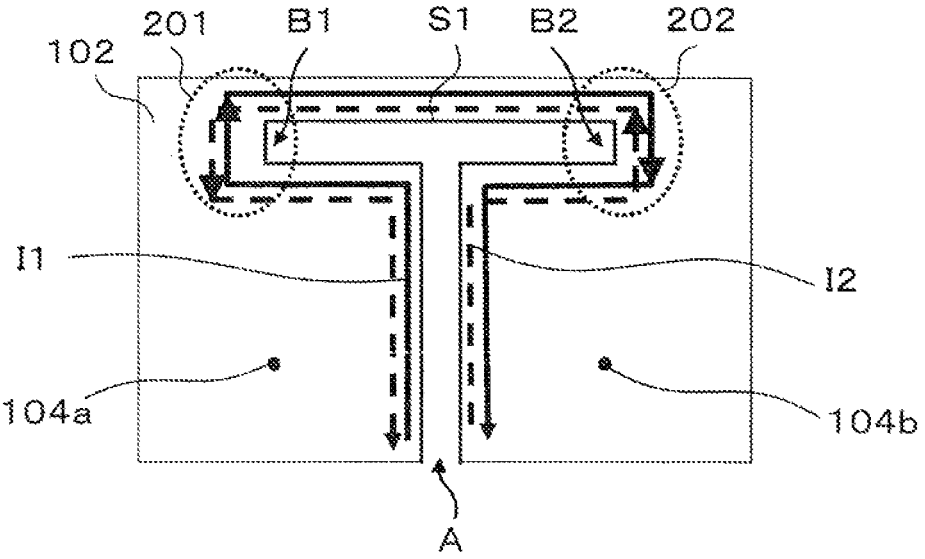
FIG. 3 is a diagram showing a current path around the slit S1 of FIG. 2.
Figure 4:
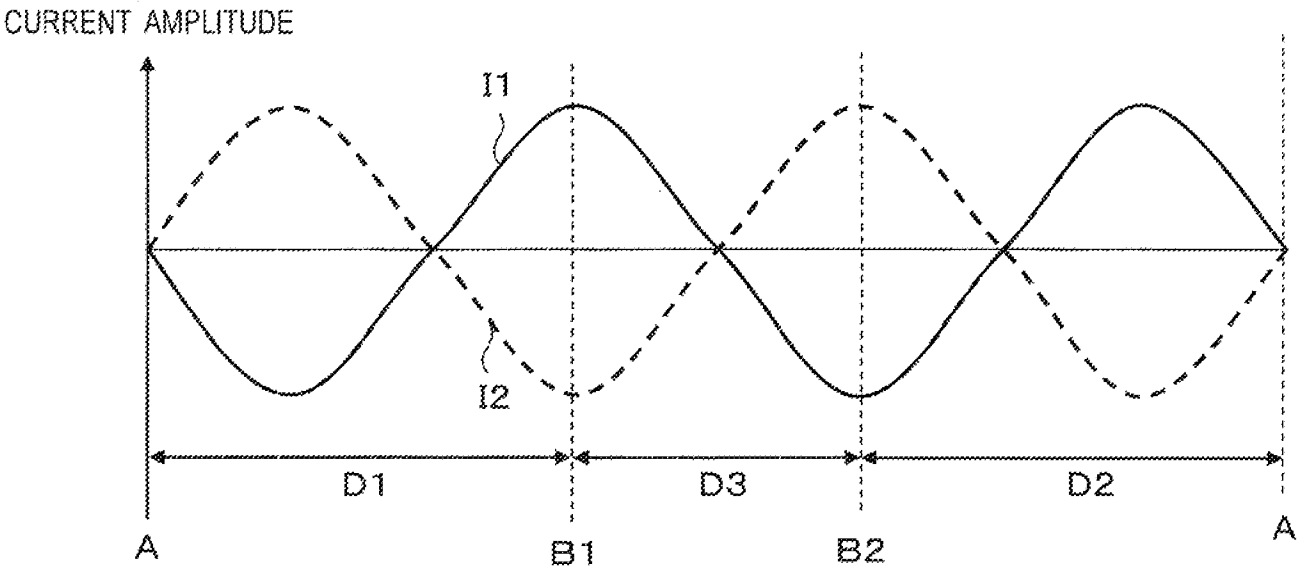
FIG. 4 is a diagram showing current amplitudes along the current path of FIG. 3.

FIG. 3 is a diagram showing the current path around the slit S1 of FIG. 2. As shown in FIG. 3, a current I1 (solid line) flows by exciting through the feed point 104*a*, and a current I2 (dashed line) flows by exciting through the feed point 104*b*. As described above, an antinode of the current I1 is formed near one of the closed ends B1 and B2 of the slit S1, and an antinode of the current I2 is formed near the other one of the closed ends B1 and B2. Further, it is preferable that the currents I1 and I2 flow in opposite direction to each other in a region 201 near the closed end B1, and the currents I1 and I2 flow in opposite directions to each other in a region 202 near the closed end B2. FIG. 4 is a diagram showing current amplitudes along the current path of FIG. 3 for this case. A current distribution of the current I1 has a current distribution substantially reversed from a current distribution of the current I2. Thus, the current distribution of the current I1 is different from the current distribution of the current I2, and accordingly, it is possible to achieve different radiation characteristics by generating different current distributions.

Figure 5:
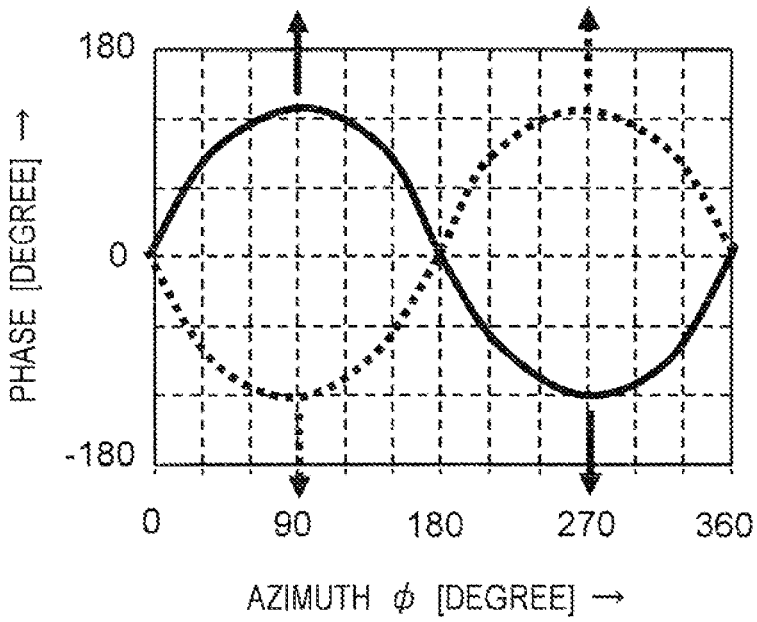
FIG. 5 is a diagram showing phase versus azimuth characteristics of the antenna apparatus 101 of FIG. 1.

FIG. 5 is a diagram showing phase versus azimuth characteristics of the antenna apparatus 101 of FIG. 1. FIG. 5 shows the phase characteristics of the vertical polarization components with respect to the azimuth $\phi$ of a horizontal plane (XY plane), for radiation produced by the current I1 of FIG. 3 (solid line), and for radiation produced by the current I2 of FIG. 3 (dashed line). The azimuth $\phi$ is defined as a direction of rotation from a +X direction to a +Y direction of FIG. 1. Taking into account particularly the currents in the regions 201 and 202 near the respective closed ends B1 and B2, the case is considered in which in the region 201 the current I1 flows upward and the current I2 flows downward, and in the region 202 the current I1 flows downward and the current I2 flows upward. The phase of vertical polarization components is a combined phase of the phase of radiation produced by the currents in the region 201 and the phase of radiation produced by the currents in the region 202. When a receiving antenna (not shown) is located in the +X direction ($\phi$=0 degrees), both the radiations produced by the current I1 and produced by the current I2 have 0 degree in phase. When the receiving antenna is moved from the +X direction ($\phi$=0 degrees) to a positive direction in the azimuth $\phi$, the receiving antenna gets closer to the closed end B2 than to the closed end B1, and thus, the radiations change such that the contribution of the radiation produced by the currents in the region 202 is greater than that of the radiation produced by the currents in the region 201, and accordingly, the combined phase includes phase rotation corresponding to this change. Hence, the characteristic curve of phase versus azimuth $\phi$ is sinusoidal, and thus, the phase characteristic curve has antinodes at the aimuths $\phi$=90 degrees and 270 degrees, at which the difference between a distance from the receiving antenna to the closed end B1 and a distance from the receiving antenna to the closed end B2 is maximized. Since the currents I1 and I2 flow in opposite directions to each other as described above, the phase characteristic curve of the radiation produced by the current I2 is shifted by 180 degrees in the azimuth $\phi$ to that of the radiation produced by the current I1. Thus, since the characteristic curves of phase versus azimuth $\phi$ exhibits different behaviors when exciting through the feed point 104*a* and when exciting through the feed point 104*b*, it is possible to reduce the correlation between radio signals associated with the respective feed points 104*a* and 104*b*. The larger the distance between the closed ends B1 and B2 of the slit S1 where the antinodes of the currents I1 and I2 are formed, the greater the effect of reducing the correlation.

Figure 6:
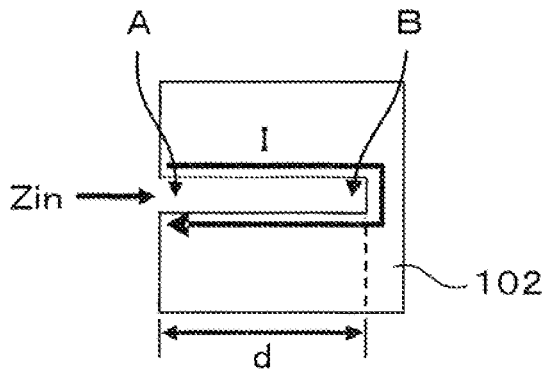
FIG. 6 is a schematic diagram for explaining an effect of providing the antenna element 102 with a slit.
Figure 7:
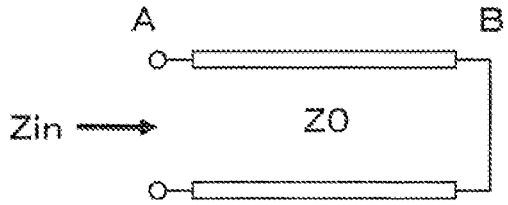
FIG. 7 is a diagram showing an equivalent circuit of the slit of FIG. 6.

With reference to FIGS. 6 and 7, the principle of producing isolation by providing the antenna element 102 with an exemplary slit will be described. FIG. 6 is a schematic diagram for explaining an effect of providing the antenna element 102 with a slit, and FIG. 7 is a diagram showing an equivalent circuit of the slit of FIG. 6. Referring to FIG. 6, in order to increase isolation between feed points (not shown), the antenna element 102 has a slit with a length d from an opening A to a closed end B. For ease of explanation, a linear slit is used instead of a T-shaped slit. When exciting the antenna element 102 through the feed points, the slit also resonates. Since a current I between the feed points flows along the slit, the slit can be represented by an equivalent circuit such as that shown in FIG. 7. If Zin is an input impedance as seen from the opening A of the slit, the input impedance Zin can be given by the following equation:

$$Zin=j\cdot Z0\cdot\tan(\beta\cdot d) \qquad \text{[Equation 1]}$$

where Z0 is the characteristic impedance of a transmission line, $\beta$ is the phase constant ($\beta=2\pi/\lambda$), and $\lambda$ is the wavelength. If the input impedance Zin of Equation 1 goes to infinity, the current between the feed points decreases. This condition is satisfied when $d=\lambda/4$, and at a frequency associated with this wavelength it is possible to achieve high isolation between the feed points.

Since the resonance frequency of the antenna element 102 and the frequency at which high isolation can be achieved change depending on the length of the slit S1, the length of the slit S1 is determined so as to adjust these frequencies. Specifically, by providing the slit S1, the resonance frequency of the antenna element 102 itself decreases. Further, the slit S1 operates as a resonator according to the length of the slit S1. Since the slit S1 is electromagnetically coupled to the antenna element 102 itself, the resonance frequency of the antenna element 102 changes according to the frequency satisfying the resonance condition of the slit S1, compared to the case with no slit S1. By providing the slit S1, it is possible to change the resonance frequency of the antenna element 102, and increase the isolation between the feed ports at a frequency.

In general, the frequency at which high isolation can be achieved by providing the slit S1 is not identical to the resonance frequency of the antenna element 102. Therefore, according to the present embodiment, the matching circuits 112*a* and 112*b* are provided to shift the operating frequency of the antenna element 102 (i.e., the frequency at which desired signals are transmitted and/or received) from the changed resonance frequency due to the slit S1, to an isolation frequency. Providing the matching circuits 112*a* and 112*b* affects both the resonance frequency and the isolation frequency, but mainly contributes to changing the resonance frequency.

As described above, according to the antenna apparatus 101 and the radio signal processing circuit 111 of the present embodiment, it is possible to provide isolation between the feed points 104*a* and 104*b* on the antenna element 102, and provide the antenna element 102 with the slit S1 forming a current path around the slit S1 and excite through the feed points 104*a* and 104*b* to generate different current distributions along the current path for different feed points, thus achieving different radiation characteristics for different feed points. Accordingly, the antenna apparatus 101 and the radio signal processing circuit 111 of the present embodiment can simultaneously transmit and/or receive two radio signals with low correlation to each other, with different radiation characteristics, while having a simple configuration.

The shapes of the antenna element 102 and the ground conductor103 are not limited to rectangular, and may be of any of other polygons, a circle, and an ellipse, etc. In addition, the antenna element 102 and the ground conductor 103 do not need to be configured to fully overlap each other, and may be configured to at least partially overlap each other, or may be configured as a dipole antenna, as will be described later. The resonance frequency of the antenna apparatus 101 can be adjusted by changing the positions of the feed points 104*a* and 104*b* and changing the positions of the connecting conductors 106 and 107. In addition, instead of connecting the antenna element 102 to the ground conductor 103 by the plurality of connecting conductors 106 and 107, the antenna element 102 and the ground conductor 103 may be connected to each other by a single conductive plate.

Figure 8:
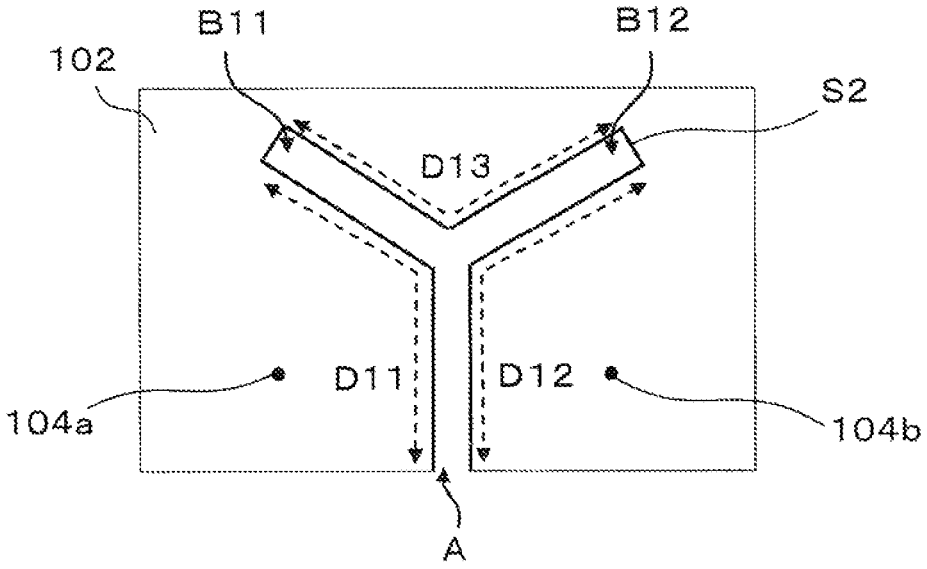
FIG. 8 is a diagram showing a configuration of an antenna element 102 according to a first modified embodiment of the first embodiment of the present invention.

FIG. 8 is a diagram showing a configuration of an antenna element 102 according to a first modified embodiment of the first embodiment of the present invention. The slit is not limited to a T-shaped slit, and the slit may be, for example, a Y-shaped slit S2. The slit can be of any shape as long as a current path around the slit includes an extent along a direction (a Y-axis direction as described with reference to FIG. 1) so that radiation characteristics in a given plane (in an XY plane as described with reference to FIG. 1) change according to a current distribution along the current path. The electrical lengths D11, D12, and D13 of the current path (i.e., the dimensions of the slit S2) are determined such that a current antinode is formed near one of closed ends B11 and B12 of the slit S2 by exciting through one feed point 104*a*, and a current antinode is formed near the other one of the closed ends B11 and B12 by exciting through the other feed point 104*b*. Specifically, the electrical length D11 is set to $(1/4+(n1)/2)\lambda$, and the electrical length D12 is set to $(1/4+(n2)/2)\lambda$, where $\lambda$ is the wavelength of radio waves to be transmitted and/or received, and n1 and n2 are integers, respectively. Further, the electrical length D13 is set to a length of, preferably $\lambda/2$, or its odd multiple. Alternatively, the electrical length D11+D13 may be set to $(1/4+(n1)/2)\lambda$, and the electrical length D12+D13 may be set to $(1/4+(n2)/2)2$. Since the slit S2 is configured in the above-described manner, a current distribution along the current path generated by exciting through one feed point 104*a* is different from a current distribution along the current path generated by exciting through the other feed point 104*b*. According to an antenna apparatus 101 including the antenna element 102 of the present modified embodiment, it is possible to generate different current distributions for different feed points, thus achieving different radiation characteristics for different feed points. Accordingly, the antenna apparatus 101 including the antenna element 102 of the present modified embodiment and a radio signal processing circuit 111 can simultaneously transmit and/or receive two radio signals with low correlation to each other, with different radiation characteristics, while having a simple configuration.

Figure 9:
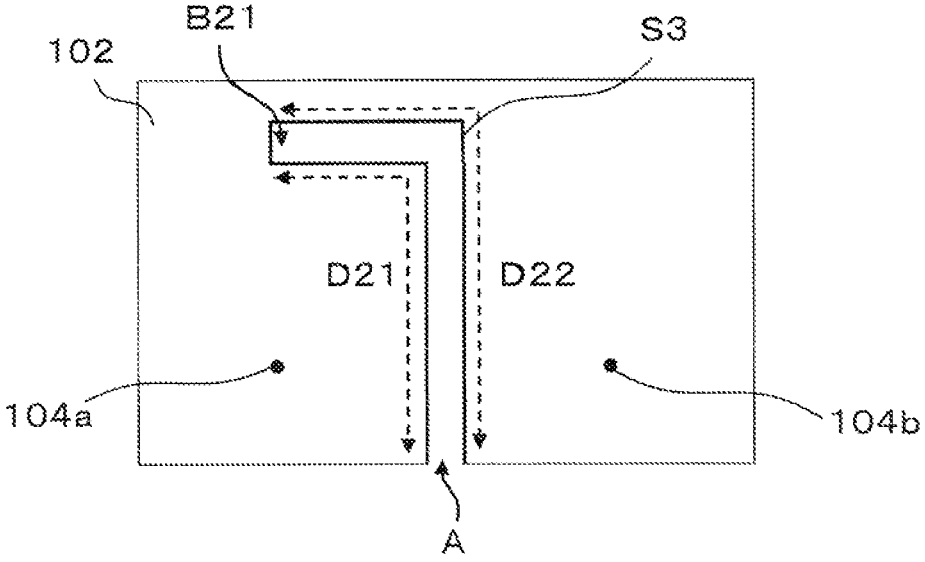
FIG. 9 is a diagram showing a configuration of an antenna element 102 according to a second modified embodiment of the first embodiment of the present invention.

FIG. 9 is a diagram showing a configuration of an antenna element 102 according to a second modified embodiment of the first embodiment of the present invention. The slit is not limited to be configured in a symmetric shape such as those of FIGS. 1 and 8, and the slit may be configured asymmetrically. The electrical lengths D21 and D22 of a current path (i.e., the dimensions of a slit S3) are determined such that a current antinode is formed near a closed end B21 of the slit S3 by exciting through one of feed points 104*a* and 104*b*. Specifically, only one of the electrical lengths D21 and D22 is set to $(1/4+n/2)\lambda$, where $\lambda$ is the wavelength of radio waves to be transmitted and/or received, and n is an integer. Since the slit S3 is configured in the above-described manner, a current distribution along the current path generated by exciting through one feed point 104*a* is different from a current distribution along the current path generated by exciting through the other feed point 104*b*. According to an antenna apparatus 101 including the antenna element 102 of the present modified embodiment, it is possible to generate different current distributions for different feed points, thus achieving different radiation characteristics for different feed points. By using an asymmetric slit as shown in the present modified embodiment, it is possible to increase the difference between current distributions each obtained when exciting through a corresponding one of the feed points, as compared to the case of using a symmetric slit. However, it is preferable to use a symmetric slit in terms of impedance matching of the antenna apparatus 101. As described above, the antenna apparatus 101 including the antenna element 102 of the present modified embodiment and a radio signal processing circuit 111 can simultaneously transmit and/or receive two radio signals with low correlation to each other, with different radiation characteristics, while having a simple configuration.

Figure 10:
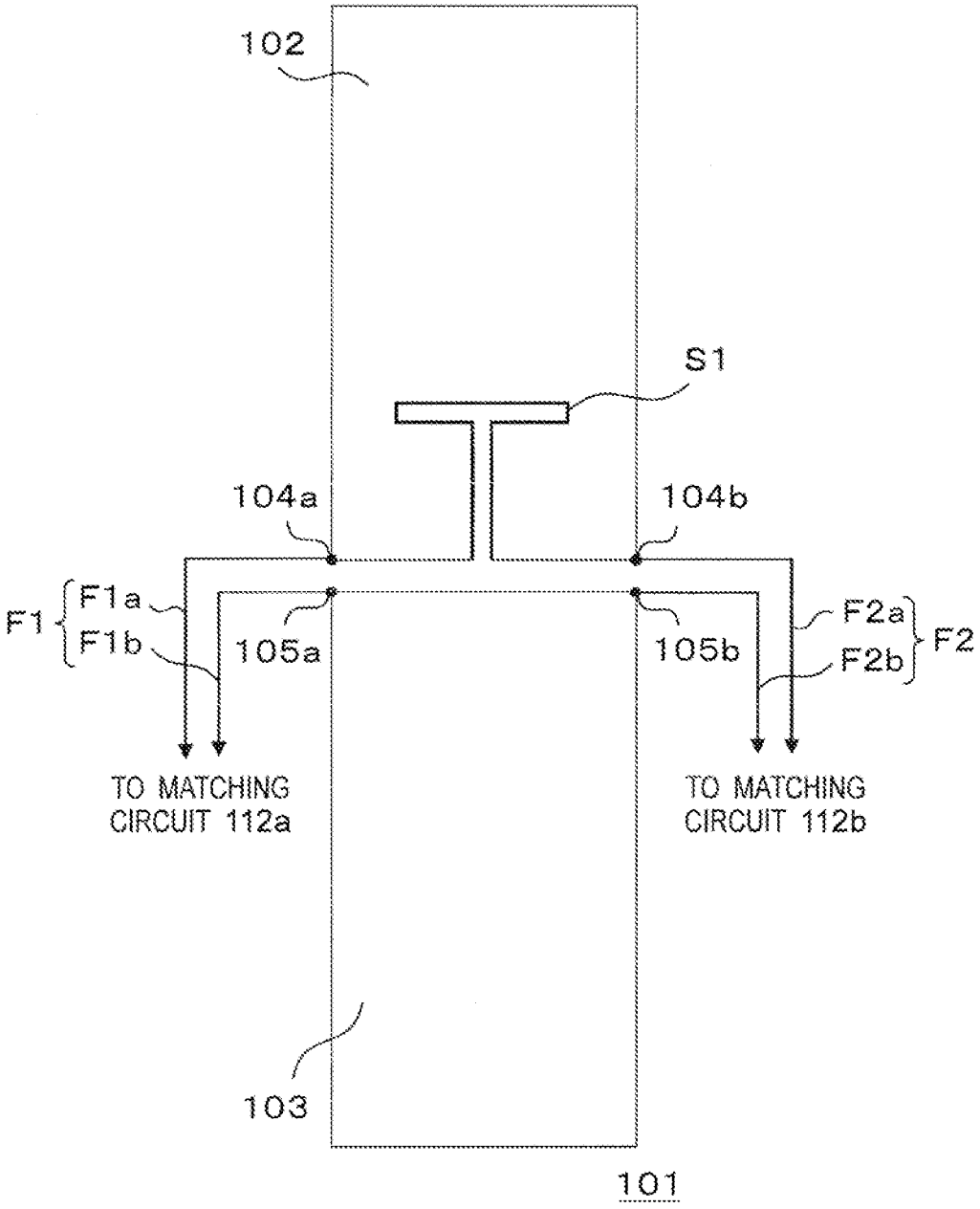
FIG. 10 is a diagram showing a configuration of an antenna apparatus 101 according to a third modified embodiment of the first embodiment of the present invention.

FIG. 10 is a diagram showing a configuration of an antenna apparatus 101 according to a third modified embodiment of the first embodiment of the present invention. The antenna apparatus 101 of the present modified embodiment is characterized by being configured as a dipole antenna apparatus, instead of being configured as an inverted-F antenna apparatus such as that of FIG. 1.

The antenna apparatus 101 of FIG. 10 includes an antenna element 102 and a ground conductor 103, each made of a rectangular conductive plate. The antenna element 102 and the ground conductor 103 are spaced apart from each other by a certain distance, such that one side of the antenna element 102 is opposed to one side of the ground conductor 103. Two feed ports are provided on the pair of opposing sides of the antenna element 102 and the ground conductor 103. One feed port includes the feed point 104*a* provided on the antenna element 102 at the side opposed to the ground conductor 103, and includes a connection point 105*a* provided on the ground conductor 103 at the side opposed to the antenna element 102. The other feed port includes the feed point 104*b* provided on the antenna element 102 at the side opposed to the ground conductor 103, and includes a connection point 105*b* provided on the ground conductor 103 at the side opposed to the antenna element 102. The antenna element 102 is further provided with the same slit S1 as shown in FIG. 1, between the two feed ports, i.e., between the feed points 104*a* and 104*b*. One end of the slit S1 is configured as an open end, with an opening on the side between the feed points 104*a* and 104*b*. The feed point 104*a* and the connecting point 105*a* are connected to a matching circuit 112*a* through a feed line F1. Similarly, the feed point 104*b* and the connecting point 105*b* are connected to a matching circuit 112*b* through a feed line F2. Each of the feed lines F1 and F2 may be made of, for example, a coaxial cable with a characteristic impedance of 50Ω. Alternatively, each of the feed lines F1 and F2 may be formed as a balanced feed line. According to the present modified embodiment configured as described above, it is possible for the single antenna element 102 to operate as two antenna portions by exciting the antenna element 102 through one feed port (i.e., the feed point 104*a*) as a first antenna portion, and simultaneously, exciting the antenna element 102 through the other feed port (i.e., the feed point 104*b*) as a second antenna portion.

In the case in which the ground conductor 103 is of a similar size to that of the antenna element 102 as illustrated in FIG. 10, the antenna apparatus 101 can be regarded as a dipole antenna made of the antenna element 102 and the ground conductor 103. The ground conductor 103 is excited as a third antenna portion through one feed port (i.e., the connection point 105*a*), and simultaneously excited as a fourth antenna portion through the other feed port (i.e., the connection point 105*b*), and thus, the ground conductor 103 also operate as two antenna portions. In this case, since an image (mirror image) of the slit 51 is formed on the ground conductor 103, it is also possible to achieve isolation between the feed ports for the third and fourth antenna portions. With the above-described configuration, it is possible to excite the first and third antenna portions as a first dipole antenna portion through one feed port, and simultaneously, excite the second and fourth antenna portions as a second dipole antenna portion through the other feed port, and thus, a single dipole antenna (i.e., the antenna element 102 and the ground conductor 103) can operate as two dipole antenna portions. Thus, the antenna apparatus of the present modified embodiment can operate the single dipole antenna as two dipole antenna portions, while achieving isolation between the feed ports with a simple configuration, and simultaneously transmit and/or receive a plurality of radio signals.

In the antenna apparatus 101 of FIG. 10, a slit may be provided in the ground conductor 103, instead of being provided in the antenna element 102. Alternatively, slits may be provided in both the antenna element 102 and the ground conductor 103. In addition, a slit S2 or S3 of FIG. 8 or 9 may be provided instead of the same slit S1 as shown in FIG. 1.

According to the antenna apparatus 101 of FIG. 10, it is possible to provide isolation between the feed points 104*a* and 104*b* on the antenna element 102, and provide the antenna element 102 with the slit S1 forming a current path around the slit S1 and excite through the feed points 104*a* and 104*b* to generate different current distributions along the current path for different feed points, thus achieving different radiation characteristics for different feed points, as described with reference to the antenna apparatus 101 of FIG. 1. Accordingly, the antenna apparatus 101 of the present modified embodiment can simultaneously transmit and/or receive two radio signals with low correlation to each other, with different radiation characteristics, while having a simple configuration.

Second Embodiment

Figure 11:
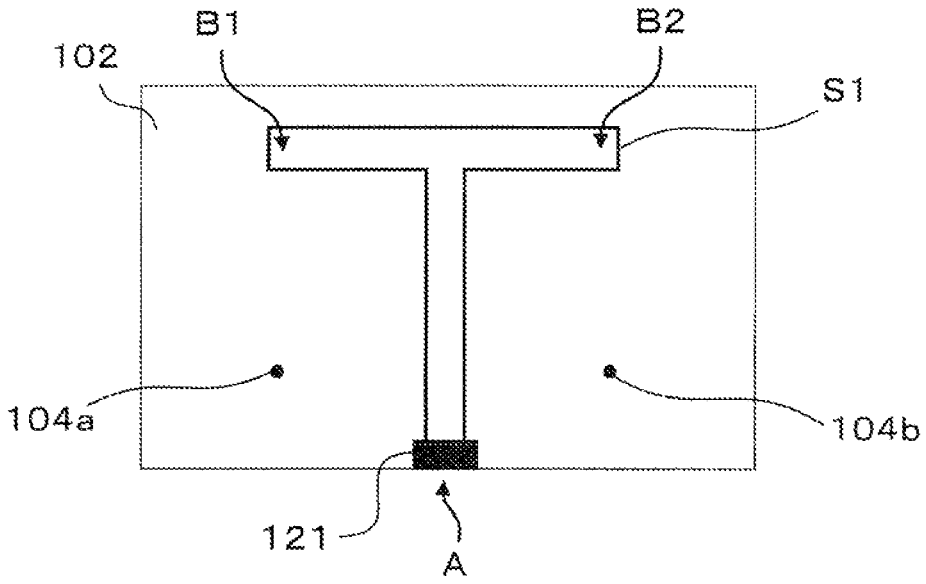
FIG. 11 is a block diagram showing a configuration of an antenna element 102 according to a second embodiment of the present invention.

FIG. 11 is a block diagram showing a configuration of an antenna element 102 of a wireless communication apparatus according to a second embodiment of the present invention. An antenna apparatus of the present embodiment is characterized by being provided with a reactance element 121 at a position along a slit S1 in order to adjust the resonance frequency of the antenna element 102 and the frequency at which high isolation can be achieved.

The antenna element 102 of FIG. 11 is configured as shown in FIG. 1, and is further provided with the reactance element 121 at a position along the slit S1, with a distance from an opening A of the slit S1 (in FIG. 11, the position of the opening A). As will be described later with reference to FIGS. 12 and 13, since the resonance frequency of the antenna element 102 and the frequency at which high isolation can be achieved change depending on the length of the slit S1, the length of the slit S1 is determined so as to adjust these frequencies. According to the present embodiment, the reactance element 121 with a reactance value (i.e., a capacitor or an inductor) is further provided at a position along the slit S1 in order to adjust these frequencies. In addition, since these frequencies change also depending on the position along the slit S1 where the reactance element 121 is provided, the position of the reactance element 121 is determined so as to adjust these frequencies. The amount of frequency adjustment (amount of frequency shift) is maximized when the reactance element 121 is provided at the opening A of the slit S1. Thus, it is possible to finely adjust the resonance frequency of the antenna element 102 and the frequency at which high isolation can be achieved, by determining a reactance value of the reactance element 121 and then changing the position where the reactance element 121 is mounted.

Figure 12:
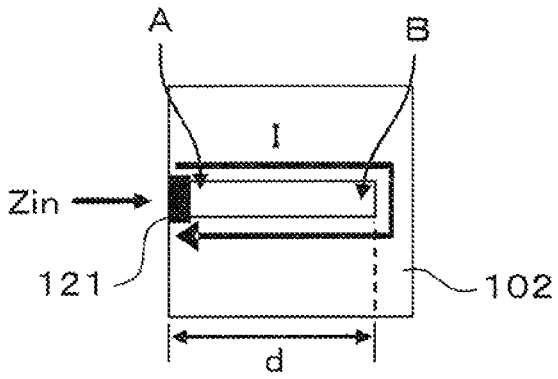
FIG. 12 is a schematic diagram for explaining an effect of providing a slit of an antenna element 102 with a reactance element 121.
Figure 13:
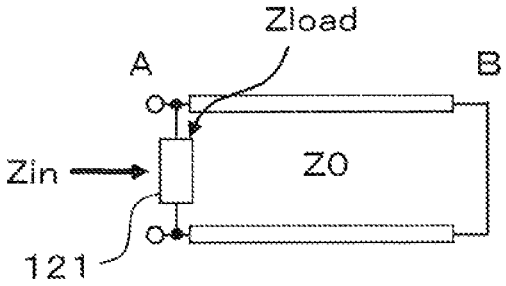
FIG. 13 is a diagram showing an equivalent circuit of the slit of FIG. 12.

With reference to FIGS. 12 and 13, the principle of providing an antenna element 102 of FIGS. 6 and 7 with a reactance element 121 and thus adjusting the frequency at which high isolation can be achieved will be described. FIG. 12 is a schematic diagram for explaining an effect of providing a slit of an antenna element 102 with a reactance element 121, and FIG. 13 is a diagram showing an equivalent circuit of the slit of FIG. 12. Referring to FIG. 12, a reactance element 121 with a reactance value Zload is mounted at an opening A of a slit with a length d. Its equivalent circuit can be represented in FIG. 13. An input admittance Yin as seen from the opening A of the slit can be given by the following equation:

$$Yin=1/Zload+1/(j\cdot Z0\cdot\tan(\beta\cdot d)) \quad \text{[Equation 2]}$$

In Equation 2, when the input impedance Zin goes to infinity, the current between feed points (not shown) decreases. Namely, the condition of achieving high isolation is that the input admittance Yin is zero. When a capacitance C is mounted as the reactance element 121, the reactance value Zload is represented by Equation 3:

$$Zload=1/(j\cdot\omega\cdot C) \quad \text{[Equation 3]}$$

By substituting Equation 3 into Equation 2 and setting Yin=0, the following equation is obtained:

$$\tan(\beta\cdot d)=1/(\omega\cdot C\cdot Z0) \quad \text{[Equation 4]}$$

According to Equation 4, it is possible to determine a frequency at which high isolation between the feed points can be achieved when mounting a capacitance at the opening A of the slit.

The configuration of an antenna apparatus provided with the reactance element 121 is not limited to the one shown in FIG. 11, and a reactance element may be provided on the antenna elements 102 of FIGS. 8 to 10.

As described above, according to an antenna apparatus 101 including the antenna element 102 of the present embodiment and a radio signal processing circuit 111, it is possible to provide isolation between the feed points 104*a* and 104*b* on the antenna element 102, and provide the antenna element 102 with the slit S1 forming a current path around the slit S1 and excite through the feed points 104*a* and 104*b* to generate different current distributions along the current path for different feed points, thus achieving different radiation characteristics for different feed points. Further, since the antenna apparatus 101 including the antenna element 102 of the present embodiment and the radio signal processing circuit 111 are provided with the reactance element 121, it is possible to adjust the resonance frequency of the antenna element 102 and the frequency at which high isolation can be achieved. Accordingly, the antenna apparatus 101 including the antenna element 102 of the present embodiment and the radio signal processing circuit 111 can simultaneously transmit and/or receive two radio signals with low correlation to each other, with different radiation characteristics, while having a simple configuration.

Third Embodiment

Figure 14:
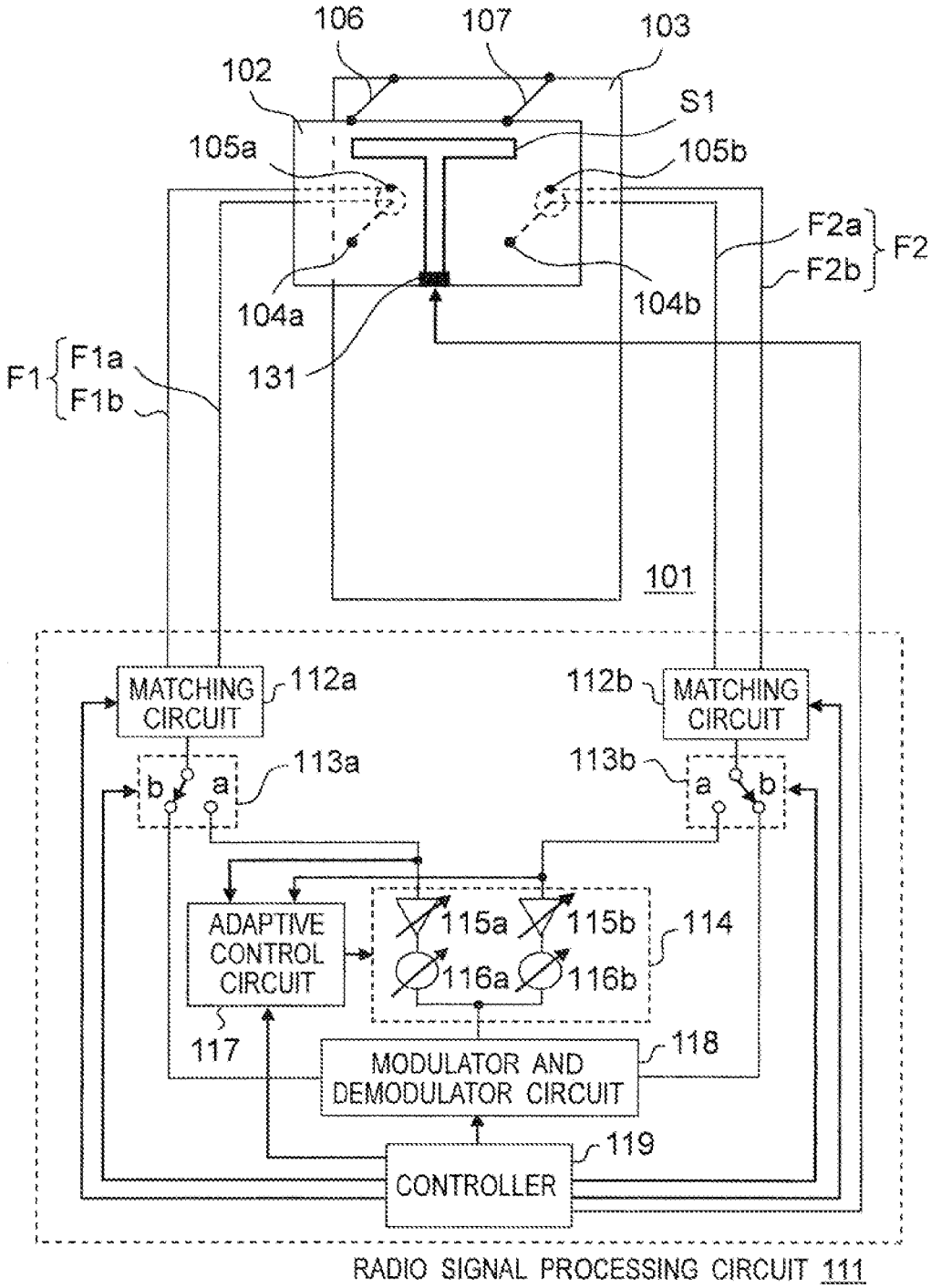
FIG. 14 is a block diagram showing the configurations of an antenna apparatus 101 and a radio signal processing circuit 111 of a wireless communication apparatus according to a third embodiment of the present invention.

FIG. 14 is a block diagram showing the configurations of an antenna apparatus 101 and a radio signal processing circuit 111 of a wireless communication apparatus according to a third embodiment of the present invention. The antenna apparatus 101 of the present embodiment is characterized by an isolation frequency adjusting circuit 131 whose reactance value changes under the control of a controller 119, instead of a reactance element 121 of the second embodiment. Thus, the antenna apparatus 101 of the present embodiment can change the frequency at which high isolation can be achieved between feed points 104*a* and 104*b*.

Figure 15:
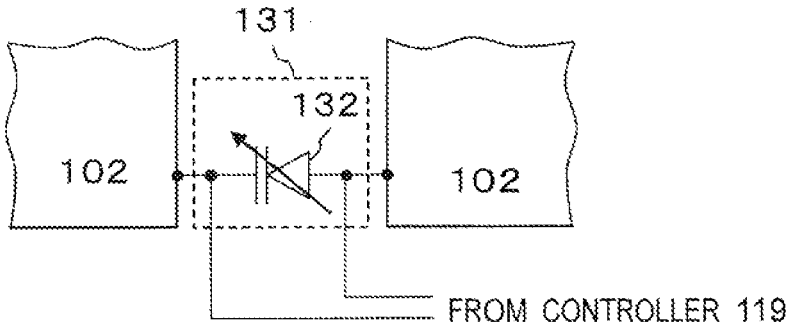
FIG. 15 is a circuit diagram showing a first exemplary implementation of an isolation frequency adjusting circuit 131 of FIG. 14.
Figure 16:
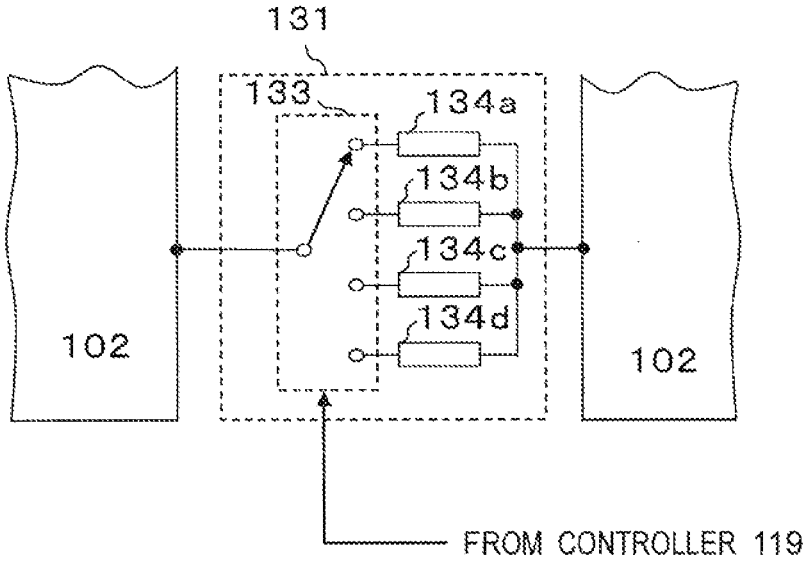
FIG. 16 is a circuit diagram showing a second exemplary implementation of the isolation frequency adjusting circuit 131 of FIG. 14.

FIG. 15 is a circuit diagram showing a first exemplary implementation of the isolation frequency adjusting circuit 131 of FIG. 14, and FIG. 16 is a circuit diagram showing a second exemplary implementation of the isolation frequency adjusting circuit 131 of FIG. 14. As the isolation frequency adjusting circuit 131, for example, it is possible to use a capacitive variable reactance element 132 (e.g., a variable capacitance element such as a varactor diode) as shown in FIG. 15. The reactance value of the variable reactance element 132 changes according to a control voltage applied from the controller 119. Alternatively, as the isolation frequency adjusting circuit 131, for example, it is possible to use a circuit for using any one of a plurality of reactance elements 134*a*, 134*b*, 134*c*, and 134*d* with different reactance values, selected by a switch 133 under the control of the controller 119, as shown in FIG. 16. The antenna apparatus 101 of the present embodiment is configured such that by changing the reactance value of the isolation frequency adjusting circuit 131, different resonance frequencies of an antenna element 102 are achieved, and high isolation between the feed points 104*a* and 104*b* is achieved at different frequencies. The controller 119 shifts the operating frequency of the antenna element 102 to a frequency at which high isolation can be achieved and which is determined according to the reactance value of the isolation frequency adjusting circuit 131, by changing the reactance value of the isolation frequency adjusting circuit 131 and by adjusting the operating frequencies of matching circuits 112*a* and 112*b* and a modulator and demodulator circuit 118. According to the present embodiment, it is possible to achieve multi-frequency operation of the antenna apparatus 101 using the above-described configuration.

As described above, according to the antenna apparatus 101 and the radio signal processing circuit 111 of the present embodiment, it is possible to provide isolation between the feed points 104*a* and 104*b* on the antenna element 102, and provide the antenna element 102 with the slit S1 forming a current path around the slit S1 and excite through the feed points 104*a* and 104*b* to generate different current distributions along the current path for different feed points, thus achieving different radiation characteristics for different feed points. Further, since the antenna apparatus 101 and the radio signal processing circuit 111 of the present embodiment are provided with the isolation frequency adjusting circuit 131, it is possible to change the frequency at which high isolation can be achieved between the feed points 104*a* and 104*b*. Accordingly, the antenna apparatus 101 and the radio signal processing circuit 111 of the present embodiment can simultaneously transmit and/or receive two radio signals with low correlation to each other, with different radiation characteristics, while having a simple configuration.

Fourth Embodiment

Figure 17:
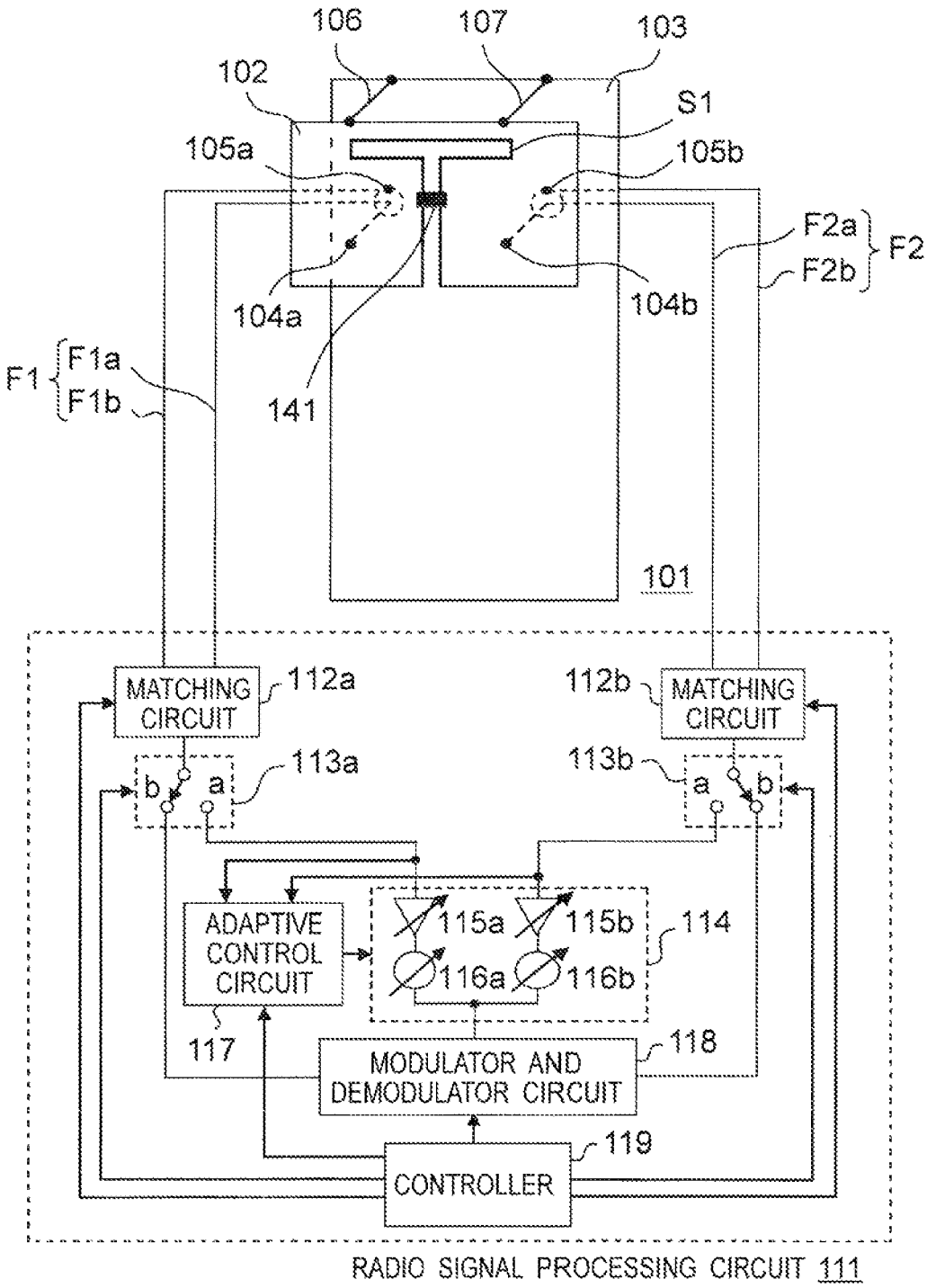
FIG. 17 is a block diagram showing the configurations of an antenna apparatus 101 and a radio signal processing circuit 111 of a wireless communication apparatus according to a fourth embodiment of the present invention.

FIG. 17 is a block diagram showing the configurations of an antenna apparatus 101 and a radio signal processing circuit 111 of a wireless communication apparatus according to a fourth embodiment of the present invention. The antenna apparatus 101 of the present embodiment is characterized by forming different current paths and current distributions around a slit S1, according to the operating frequency. Thus, the antenna apparatus 101 of the present embodiment is characterized by, at each of a plurality of frequencies, achieving high isolation between the feed points 104*a* and 104*b*, and simultaneously transmitted and/or received two radio signals with low correlation to each other.

The antenna apparatus 101 of FIG. 17 is provided with a filter circuit 141 at a position along the slit S1 with a distance from an opening of the slit S1, instead of an isolation frequency adjusting circuit 131 of the third embodiment. The filter circuit 141 is opened only at a resonance frequency and is short-circuited at the other frequencies. At a frequency identical to this resonance frequency (hereinafter, referred to as a "low frequency"), the filter circuit 141 is opened, and thus, the entire slit S1 resonates, and the same current path as that of FIG. 3, which does not pass through the filter circuit 141, is formed. At a frequency higher than the resonance frequency (hereinafter, referred to as a "high frequency"), the filter circuit 141 is short-circuited, and thus, only a section of the slit S1 from its opening to the filter circuit 141 resonates, and a current path, which flows from the opening (e.g., on the side of a feed point 104*a*) to the filter 141, passes through the filter circuit 141, and returns again to the opening (e.g., on the side of a feed point 104*b*), is formed. Thus, the filter circuit 141 changes the resonating electrical length of the slit S1 (therefore, the resonance frequency of an antenna element 102 and the frequency at which high isolation can be achieved), and changes the current path and current distribution around the slit S1, according to the operating frequency of the antenna apparatus 101. The operating frequencies of matching circuits 112*a* and 112*b* and a modulator and demodulator circuit 118 change under the control of a controller 119. The controller 119 selectively shifts the operating frequency of the antenna apparatus 101 to either one of the low frequency and the high frequency, by adjusting the operating frequencies of the matching circuits 112*a* and 112*b* and the modulator and demodulator circuit 118.

Thus, at the low frequency, it is possible to form the same current path as that of FIG. 3 around the slit S1 and excite through the feed points 104*a* and 104*b* to generate different current distributions along the current path for different feed points, thus achieving different radiation characteristics for different feed points. At the high frequency, although it is not possible to form a current path passing through regions 201 and 202 near closed ends B1 and B2 of the slit S1 in the manner shown in FIG. 3, sufficient isolation can be achieved by resonating only the section of the slit S1 from its opening to the filter circuit 141.

Figure 18:
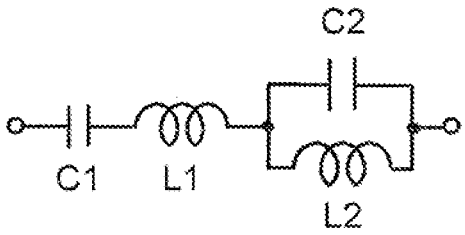
FIG. 18 is a circuit diagram showing a first exemplary implementation of a filter circuit 141 of FIG. 17.
Figure 19:
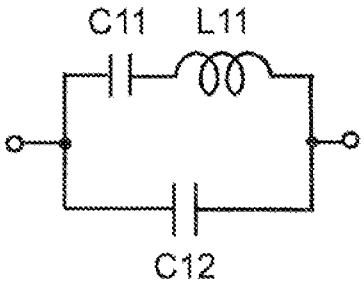
FIG. 19 is a circuit diagram showing a second exemplary implementation of the filter circuit 141 of FIG. 17.
Figure 20:
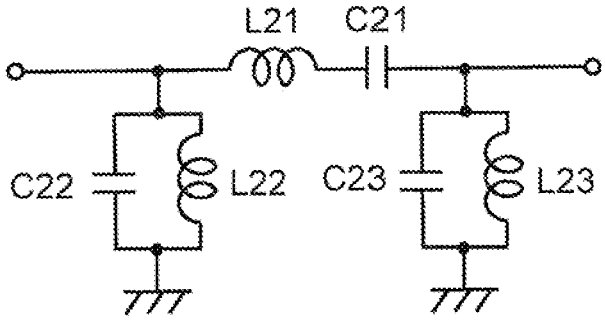
FIG. 20 is a circuit diagram showing a third exemplary implementation of the filter circuit 141 of FIG. 17.
Figure 21:
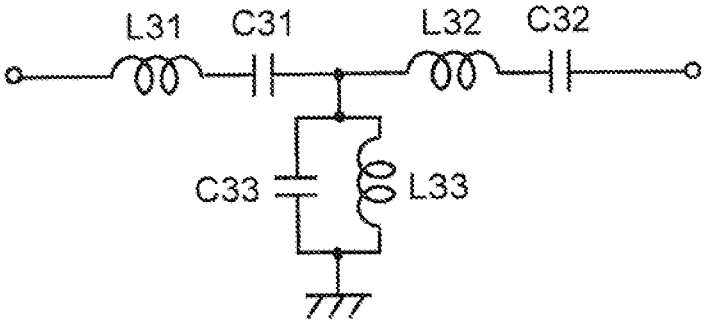
FIG. 21 is a circuit diagram showing a fourth exemplary implementation of the filter circuit 141 of FIG. 17.
Figure 22:
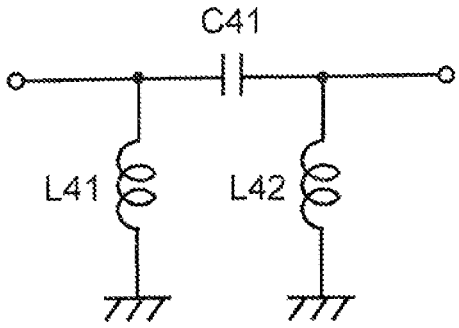
FIG. 22 is a circuit diagram showing a fifth exemplary implementation of the filter circuit 141 of FIG. 17.
Figure 23:
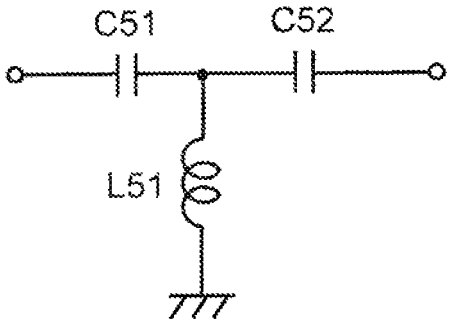
FIG. 23 is a circuit diagram showing a sixth exemplary implementation of the filter circuit 141 of FIG. 17.
Figure 24:
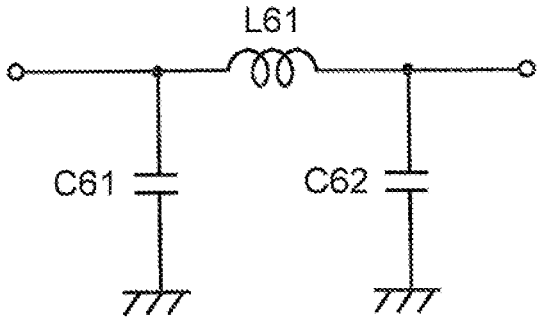
FIG. 24 is a circuit diagram showing a seventh exemplary implementation of the filter circuit 141 of FIG. 17.
Figure 25:
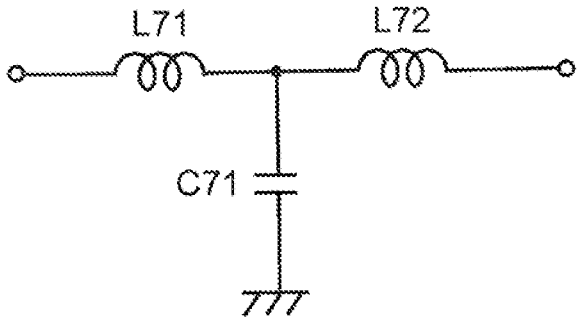
FIG. 25 is a circuit diagram showing an eighth exemplary implementation of the filter circuit 141 of FIG. 17.

FIGS. 18 to 25 are circuit diagrams showing first to eighth exemplary implementations of the filter circuit 141 of FIG. 17. The exemplary implementations of FIGS. 18 and 19 show the case in which the filter circuit 141 is configured as a trap circuit. The circuit shown in FIG. 18 is such that a series circuit including an inductor L1 and a capacitor C1 is connected in series with a parallel circuit including an inductor L2 and a capacitor C2. Since the impedance of a parallel circuit portion including the inductor L2 and the capacitor C2 is infinity at a resonance frequency $f1=1/(2\pi\sqrt{L2\cdot C2})$, the filter circuit 141 of FIG. 18 is electrically opened at the frequency f1. In addition, the same effect as that of the circuit of FIG. 18 is obtained also when using a circuit in which a series circuit including an inductor L11 and a capacitor C11 is connected in parallel with a capacitor C12 as shown in FIG. 19. In addition, the exemplary implementations of FIGS. 20 and 21 show the case in which the filter circuit 141 is configured as a band-pass filter. The exemplary implementations of FIGS. 22 and 23 show the case in which the filter circuit 141 is configured as a high-pass filter. The exemplary implementations of FIGS. 24 and 25 show the case in which the filter circuit 141 is configured as a low-pass filter.

In addition, the filter circuit 141 may be configured as a filter formed by a MEMS (Micro Electro Mechanical Systems) fabrication method.

As described above, since the antenna apparatus 101 and the radio signal processing circuit 111 of the present embodiment are provided with the slit S1 and the filter circuit 141, it is possible, at each of the low frequency and the high frequency, to achieve high isolation between the feed points 104*a* and 104*b*, and simultaneously transmit and/or receive two radio signals with low correlation to each other, with different radiation characteristics.

Figure 26:
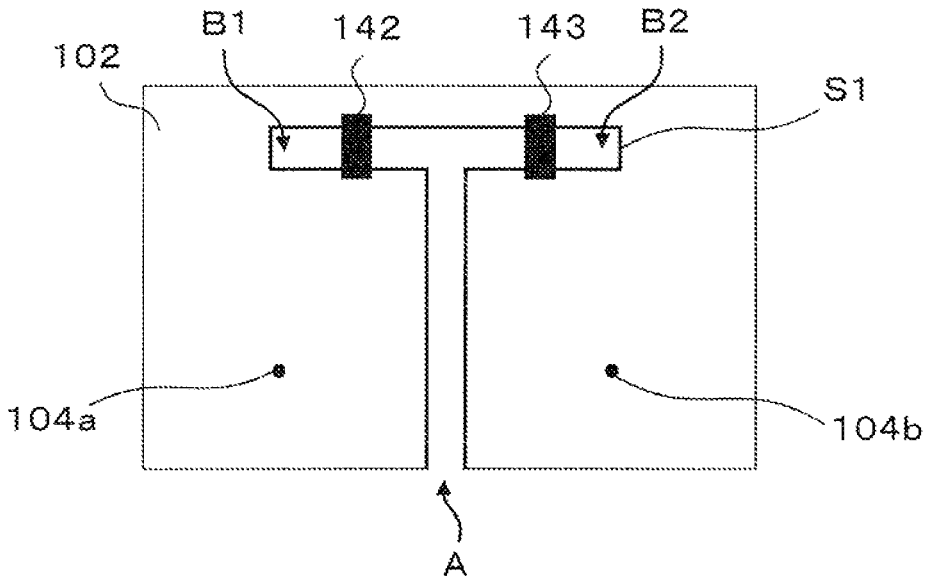
FIG. 26 is a diagram showing a configuration of an antenna element 102 according to a first modified embodiment of the fourth embodiment of the present invention.

FIG. 26 is a diagram showing a configuration of an antenna element 102 according to a first modified embodiment of the fourth embodiment of the present invention. The position of a filter circuit is not limited to the one shown in FIG. 17. For example, as shown in FIG. 26, filter circuits 142 and 143 may be provided close to closed ends B1 and B2, respectively. Only one of the filter circuits 142 and 143 may be provided in order to obtain a asymmetric current path and asymmetric current distributions.

Figure 27:
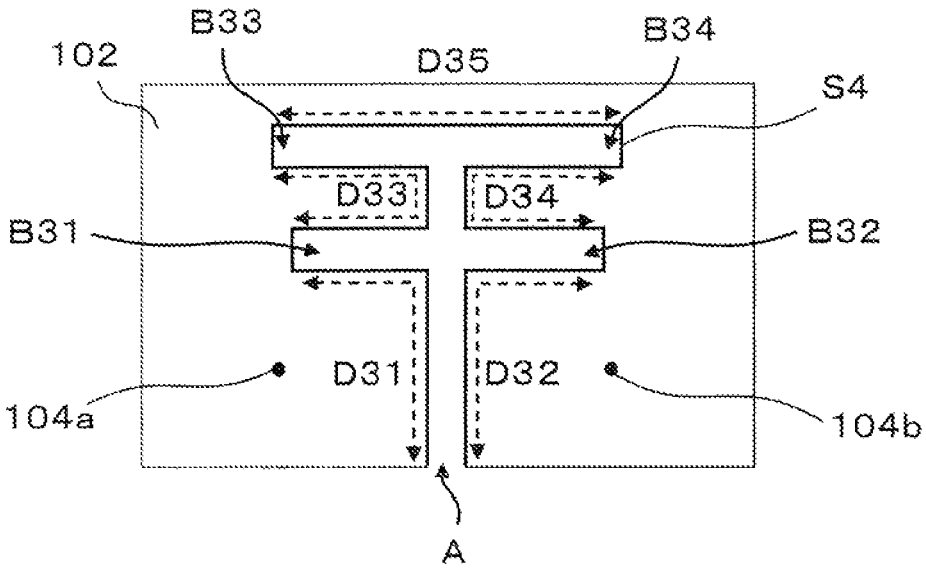
FIG. 27 is a diagram showing a configuration of an antenna element 102 according to a second modified embodiment of the fourth embodiment of the present invention.
Figure 28:
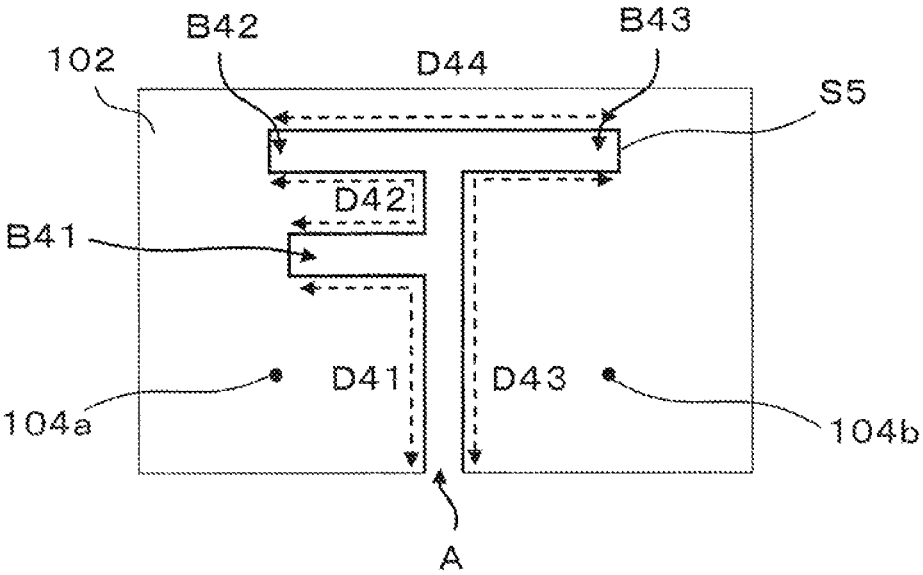
FIG. 28 is a diagram showing a configuration of an antenna element 102 according to a third modified embodiment of the fourth embodiment of the present invention.

FIG. 27 is a diagram showing a configuration of an antenna element 102 according to a second modified embodiment of the fourth embodiment of the present invention. FIG. 28 is a diagram showing a configuration of an antenna element 102 according to a third modified embodiment of the fourth embodiment of the present invention. The antenna elements 102 according to these modified embodiments are characterized in that in order to form different current paths and current distributions around a slit according to the operating frequency of an antenna apparatus 101, the slit includes a plurality of branches having closed ends with different electrical lengths of current paths to an opening of the slit, instead that the slit is provided with a filter circuit(s) as described with reference to FIGS. 17 and 26. Thus, different current paths from the opening of the slit to its different closed ends and different current distributions are formed according to the operating frequency of the antenna apparatus 101.

Referring to FIG. 27, a slit S4 includes: a first portion (a portion extending in the vertical direction of FIG. 27) extending between a side to which connecting conductors 106 and 107 (not shown) are connected and its opposite side, and having an opening A on the latter side; first and second branches provided on the left and right sides of the first portion at positions remote from the opening A by a distance; and third and fourth branches provided on the left and right sides of the first portion at positions more remote from the opening A than the first and second branches. "D31" denotes the electrical length of a current path from the opening A of the slit S4 to a closed end B31 of the first branch, "D32" denotes the electrical length of a current path from the opening A of the slit S4 to a closed end B32 of the second branch, "D33" denotes the electrical length of a current path from the closed end B31 of the first branch to a closed end B33 of the third branch, "D34" denotes the electrical length of a current path from the closed end B32 of the second branch to a closed end B34 of the fourth branch, and "D35" denotes the electrical length of a current path from the closed end B33 of the third branch to the closed end B34 of the fourth branch. The electrical lengths D31, D32, D33, D34, and D35 of the current paths (i.e., the dimensions of the slit S4) are determined such that a current antinode is formed near one of the closed ends B31, B32, B33, and B34 of the slit S4 by exciting through one feed point 104*a* at a first frequency, and a current antinode is formed near another one of the closed ends by exciting through the other feed point 104*b* at the first frequency, and similarly, current antinodes are formed near the other two closed ends by exciting through the feed points 104*a* and 104*b* at a different second frequency. Specifically, the electrical length D31+D33 is set to $(1/4+(n1)/2)\lambda 1$ and the electrical length D32+D34 is set to $(1/4+(n2)/2)\lambda 1$, where $\lambda 1$ is the wavelength of radio waves to be transmitted and/or received at the first frequency (hereinafter, referred to as a "low frequency"), and n1 and n2 are integers, respectively. In this case, by exciting through the feed point 104*a*, a current node is formed near the opening A of the slit S4 (on the side of the feed point 104*a*) and a current antinode is formed near the closed end B33; and on the other hand, by exciting through the feed point 104*b*, a current node is formed near the opening A of the slit S4 (on the side of the feed point 104*b*) and a current antinode is formed near the closed end B34. Further, the electrical length D35 is set to a length of, preferably $\lambda/2$, or its odd multiple. At the low frequency, alternatively, the electrical length D31+D33+D35 may be set to $(1/4+(n1)/2)\lambda 1$, and the electrical length D32+D34+D35 may be set to $(1/4+(n2)/2)\lambda 1$. Further, the electrical length D31 is set to $(1/4+(n3)/2)\lambda 2$, and the electrical length D32 is set to $(1/4+(n4)/2)\lambda 2$, where $\lambda 2$ is the wavelength of radio waves to be transmitted and received at the second frequency higher than the first frequency (hereinafter, referred to as a "high frequency"), and n3 and n4 are integers, respectively. In this case, by exciting through the feed point 104*a* a current node is formed near the opening A of the slit S4 (on the side of the feed point 104*a*) and a current antinode is formed near the closed end B31; and on the other hand, by exciting through the feed point 104*b*, a current node is formed near the opening A of the slit S4 (on the side of the feed point 104*b*) and a current antinode is formed near the closed end B32. Thus, the slit S4 forms different current paths from the opening A of the slit S4 to its different closed ends and thus forms different current distributions, according to the operating frequency of the antenna apparatus 101.

As described above, since the antenna apparatus 101 including the antenna element 102 of the present modified embodiment and a radio signal processing circuit 111 are provided with the slit S4 including a plurality of branches, it is possible, at each of the low frequency and the high frequency, to achieve high isolation between the feed points 104*a* and 104*b*, and simultaneously transmit and/or receive two radio signals with low correlation to each other, with different radiation characteristics.

Referring to FIG. 28, a slit S5 is configured asymmetrically by removing one of the first and second branches of the slit S4 of FIG. 27. The electrical length D41+D42 of a current path is set to $(1/4+(n1)/2)\lambda 1$, where $\lambda 1$ is the wavelength of radio waves to be transmitted and received at a first frequency (hereinafter, referred to as a "low frequency"), and n1 is an integer. In this case, by exciting through a feed point 104*a*, a current node is formed near an opening A of the slit S5 (on the side of the feed point 104*a*) and a current antinode is formed near a closed end B42. Further, the electrical length D41 of a current path is set to $(1/4+(n2)/2)\lambda 2$, where $\lambda 2$ is the wavelength of radio waves to be transmitted and received at a second frequency higher than the first frequency (hereinafter, referred to as a "high frequency"), and n2 is an integer. In this case, by exciting through the feed point 104*a*, a current node is formed near the opening A of the slit S5 (on the side of the feed point 104*a*) and a current antinode is formed near a closed end B41. An electrical length D43 of a current path is also determined such that a current node is formed near the opening A of the slit S5 (on the side of a feed point 104*b*) and a current antinode is formed near a closed end B43 by exciting through the feed point 104*b* at a frequencies. Thus, the slit S5 forms different current paths from the opening A of the slit S5 to its different closed ends and thus forms different current distributions, according to the operating frequency of an antenna apparatus 101. By using an asymmetric slit as shown in the present modified embodiment, it is possible to increase the difference between current distributions each obtained when exciting through a corresponding one of the feed points, as compared to the case of using a symmetric slit.

As described above, since the antenna apparatus 101 including the antenna element 102 of the present modified embodiment and a radio signal processing circuit 111 are provided with the slit S5 including a plurality of branches, it is possible, at each of the low frequency and the high frequency, to achieve high isolation between the feed points 104*a* and 104*b*, and simultaneously transmit and/or receive two radio signals with low correlation to each other, with different radiation characteristics.

The antenna elements 102 of FIGS. 27 and 28 may be operated only at the low frequency, instead of being operated at a plurality of frequencies. In this case, since the electrical length of a current path from the opening of a slit to its closed end is longer than that in the case of FIG. 1, it is possible to shift the frequency at which high isolation can be achieved, to the lower frequency, thus reducing the size of the antenna elements 102.

First Implementation Example

Experimental results obtained when an antenna apparatus 101 of the second embodiment is modeled as a slit antenna apparatus made of copper plates will be described below.

Figure 29:
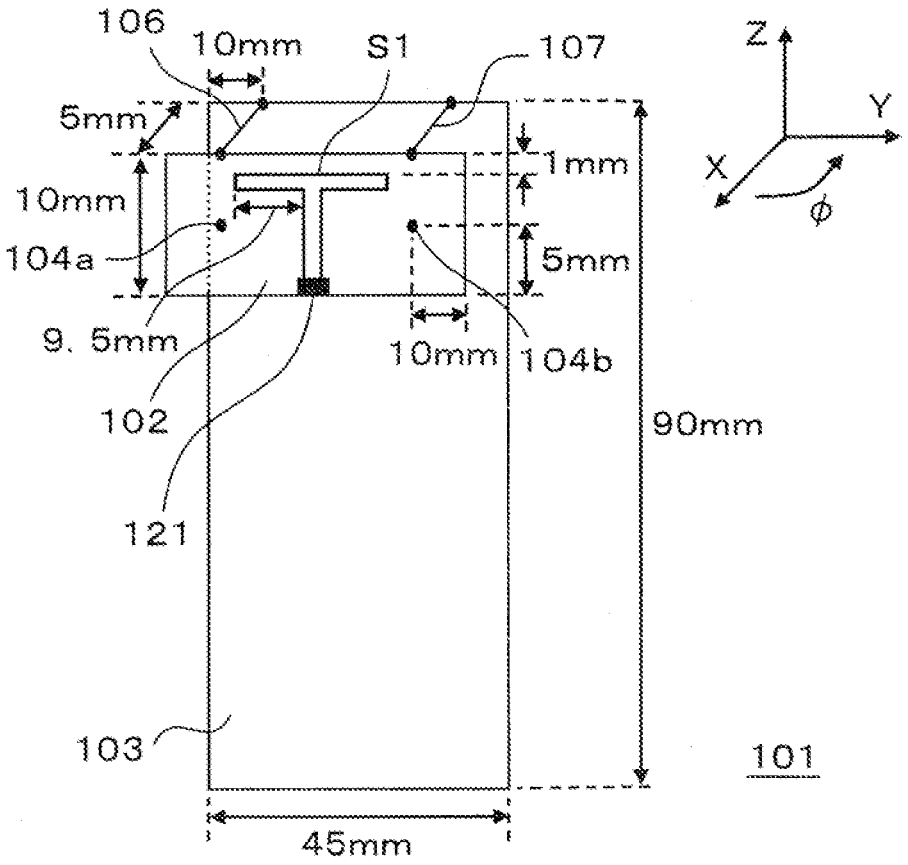
FIG. 29 is a perspective view showing a configuration of an antenna apparatus 101 according to an implementation example of the present invention.

FIG. 29 is a perspective view showing a configuration of an antenna apparatus 101 according to an implementation example of the present invention. Each of an antenna element 102 and a ground conductor 103 is made using a single-side copper-clad board. The antenna element 102 has a size of 10×45 mm, and the ground conductor 103 has a size of 45×90 mm. The antenna element 102 is disposed in parallel to the ground conductor 103, remote from the ground conductor 103 by 5 mm in a +X direction. The antenna element 102 and the ground conductor 103 are mechanically and electrically connected to each other by connecting conductors 106 and 107 at positions on the +Z sides and inward by 10 mm from both ends of these sides. A first portion of a slit S1 is formed on the antenna element 102 so as to be parallel to a Z-axis direction, with a width of 1 mm at the center in a Y-axis direction and with a length of 9 mm in a +Z direction from a −Z side of the antenna element 102. A bottom end of the first portion is an opening. Further, a second portion of the slit S1 is formed at a top end of the first portion so as to be parallel to the Y-axis direction, with a length of 9.5 mm in each of a +Y direction and a −Y direction. A reactance element 121 with a capacitance of 0.1 pF is mounted at the opening of the slit S1. Feed points 104*a* and 104*b* are provided at the center in the Z-axis direction and at a position inward by 10 mm from a −Y side and a position inward by 10 mm from a +Y side, respectively.

Figure 30:
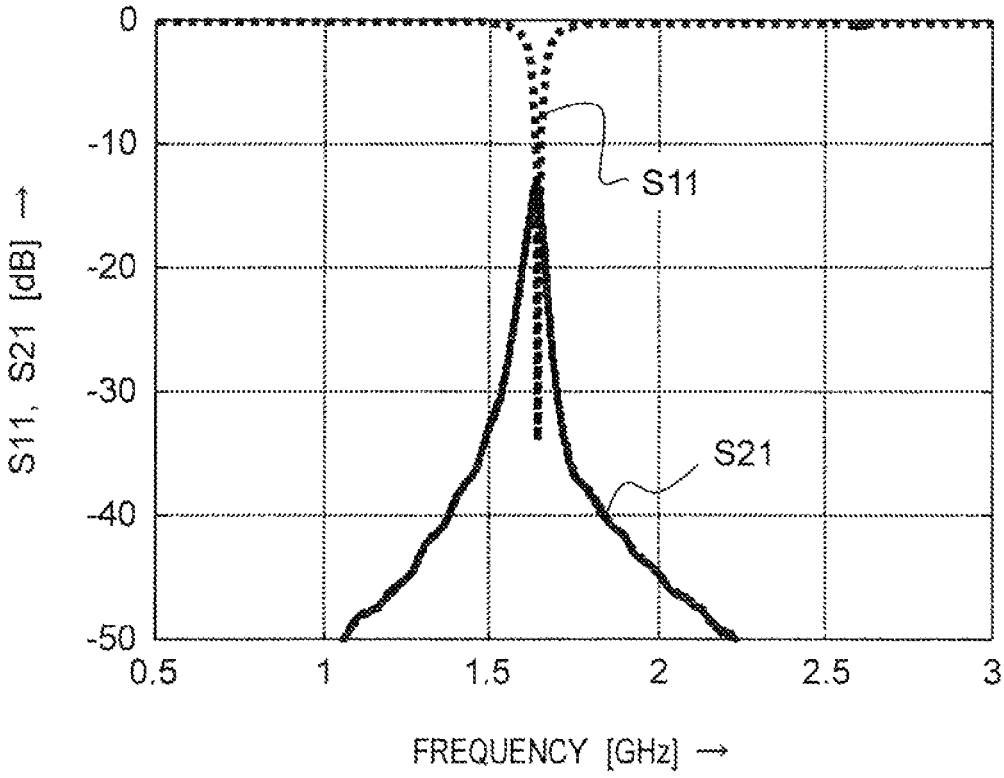
FIG. 30 is a graph showing the frequency characteristics of a transmission coefficient parameter S21 and a reflection coefficient parameter S11 between feed points 104*a* and 104*b* of the antenna apparatus 101 of FIG. 29.
Figure 31:
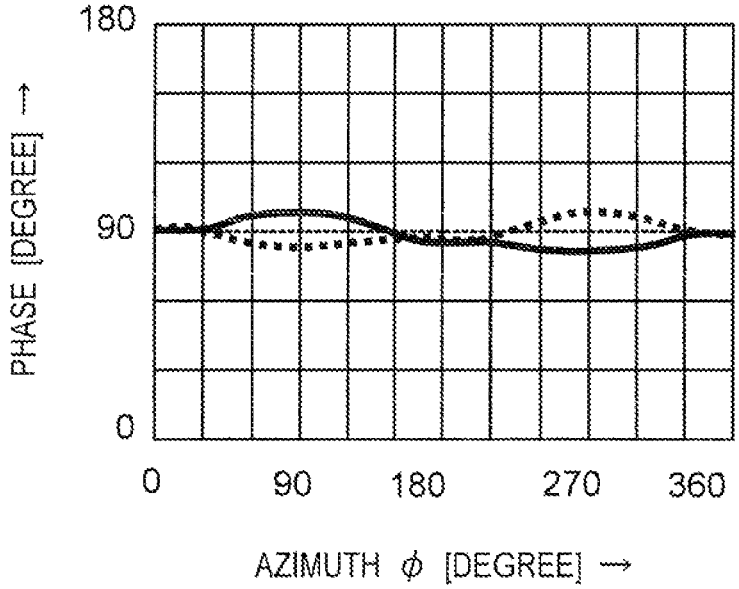
FIG. 31 is a diagram showing phase versus azimuth characteristics of the antenna apparatus 101 of FIG. 29.

FIG. 30 is a graph showing the frequency characteristics of a transmission coefficient parameter S21 and a reflection coefficient parameter S11 between the feed points 104*a* and 104*b* of the antenna apparatus 101 of FIG. 29. FIG. 31 is a diagram showing phase versus azimuth characteristics of the antenna apparatus 101 of FIG. 29. According to FIG. 30, it can be seen that when the operating frequency is 1700 MHz (when ¼ wavelength is 4.4 cm), the transmission coefficient parameter S21 is −13.7 dB, achieving high isolation. FIG. 31 shows the phase characteristics of the vertical polarization components with respect to the azimuth ϕ of a horizontal plane (XY plane), for radiation produced by exciting through the feed point 104*a* (solid line), and for radiation produced by exciting through the feed point 104*b* (dashed line). According to FIG. 31, it can be seen that those two phase characteristics are reversed at the aimuths ϕ=90 degrees and 270 degrees. The correlation coefficient between the radiations produced by exciting through the respective feed points 104*a* and 104*b* is calculated from the radiation patterns of the complex vertical polarization components in the horizontal plane (XY plane). The calculated correlation coefficient is 0.2, thus achieving low correlation.

INDUSTRIAL APPLICABILITY

Antenna apparatuses of the present invention and wireless communication apparatuses using the antenna apparatuses can be implemented as, for example, mobile phones or can also be implemented as apparatuses for wireless LANs. The antenna apparatuses can be mounted on, for example, wireless communication apparatuses performing MIMO communication, but not limited to MIMO communication, also be mounted on (multi-application) wireless communication apparatuses capable of simultaneously performing communications for a plurality of applications.

REFERENCE SIGNS LIST

101: ANTENNA APPARATUS,
102: ANTENNA ELEMENT,
103: GROUND CONDUCTOR,
104*a* and 104*b*: FEED POINT,
105*a* and 105*b*: CONNECTING POINT,
106 and 107: CONNECTING CONDUCTOR,
111: RADIO SIGNAL PROCESSING CIRCUIT,
112*a* and 112*b*: IMPEDANCE MATCHING CIRCUIT,
113*a* and 113*b*: SWITCH,
114: AMPLITUDE AND PHASE CONTROL CIRCUIT,
115*a* and 115*b*: AMPLITUDE ADJUSTER,
116*a* and 116*b*: PHASE SHIFTER,
117: ADAPTIVE CONTROL CIRCUIT,
118: MODULATOR AND DEMODULATOR CIRCUIT,
119: CONTROLLER,
121: REACTANCE ELEMENT,
131: ISOLATION FREQUENCY ADJUSTING CIRCUIT,
132: VARIABLE REACTANCE ELEMENT,
133: SWITCH,
134*a*, 134*b*, 134*c*, and 134*d*: REACTANCE ELEMENT,
141, 142, and 143: FILTER CIRCUIT,
F1 and F2: FEED LINE,
F1*a*, F1*b*, F2*a*, and F2*b*: SIGNAL LINE,
C1, C2, C11, C12, C21, C22, C23, C31, C32, C33, C41, C51, C52, C61, C62, and C71: CAPACITOR,
L1, L2, L11, L21, L22, L23, L31, L32, L33, L41, L42, L51, L61, L71, and L72: INDUCTOR, and
S1, S2, S3, and S4: SLIT.

The invention claimed is:

1. An antenna apparatus comprising first and second feed points provided at respective predetermined positions on an antenna element, wherein the antenna element is simultaneously excited through the first and second feed points so as to simultaneousy operate as first and second antenna portions, the first and second antenna portions being associated with the first and second feed points, respectively, wherein the antenna element has a slit including a first portion and a second portion, the first portion extending in a first direction so as to separate the first and second feed points from each other, and the second portion extending in a second direction different from the first direction, and wherein the slit is configured to:

resonate at an isolation frequency to produce isolation between the first and second feed points; and form a current path around the slit;

wherein a current distribution along the current path generated by exciting the antenna element through the first feed point is different from a current distribution along the current path generated by exciting the antenna element through the second feed point, thereby providing different radiation characteristics by the different current distributions;

wherein the slit is provided with a filter at a position along the slit with a distance from the opening of the slit, the filter being opened at a first frequency and being short-circuited at a second frequency different from the first frequency, and wherein the filter is configured to:

at the first frequency, allow the entire slit to resonate to produce isolation between the first and second feed points, and form a current path around the slit without short-circuiting through the filter; and at the second frequency, allow only a portion from the opening of the slit to the filter to resonate to produce isolation between the first and second feed points, and form a current path around the slit with short-circuiting through the filter.

2. The antenna apparatus as claimed in claim 1, wherein the filter is configured such that a series resonant circuit including a first inductor and a first capacitor is connected in series with a parallel resonant circuit including a second inductor and a second capacitor.

3. The antenna apparatus as claimed in claim 1, wherein the filter is configured such that a series resonant circuit including an inductor and a first capacitor is connected in parallel with a second capacitor.

4. The antenna apparatus as claimed in claim 1, wherein the filter is a band-pass filter.

5. The antenna apparatus as claimed in claim 1, wherein the filter is a high-pass filter.

6. The antenna apparatus as claimed in claim 1, wherein the filter is a low-pass filter.

7. The antenna apparatus as claimed in claim 1, wherein the filter is a filter formed by a MEMS (Micro Electro Mechanical Systems) fabrication method.

* * * * *